US007448225B2

(12) United States Patent
Iguchi et al.

(10) Patent No.: US 7,448,225 B2
(45) Date of Patent: Nov. 11, 2008

(54) COLD STORAGE

(75) Inventors: Harunobu Iguchi, Ota (JP); Yuji Yonehara, Gunma-ken (JP); Jun Satou, Ota (JP); Satoshi Hariu, Gunma-ken (JP); Hiroshi Tamayama, Ashikaga (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 321 days.

(21) Appl. No.: 11/274,342

(22) Filed: Nov. 16, 2005

(65) Prior Publication Data

US 2006/0107677 A1 May 25, 2006

(30) Foreign Application Priority Data

Nov. 25, 2004 (JP) ..... 2004-340606

(51) Int. Cl.
*A47F 3/04* (2006.01)

(52) U.S. Cl. ..... 62/255; 62/298

(58) Field of Classification Search ..... 62/246–256, 62/298

See application file for complete search history.

(56) References Cited

U.S. PATENT DOCUMENTS 3,230,733 A * 1/1966 Rutishauser et al. ..... 62/256
3,712,078 A * 1/1973 Maynard et al. ..... 62/448
5,417,079 A * 5/1995 Rudick et al. ..... 62/253
6,751,973 B2 * 6/2004 Erisgen ..... 62/246
6,948,324 B2 * 9/2005 Jin ..... 62/77

FOREIGN PATENT DOCUMENTS

JP 2000-105058 4/2000

* cited by examiner

*Primary Examiner*—William E Tapolcai
(74) *Attorney, Agent, or Firm*—Kratz, Quintos & Hanson, LLP

(57) ABSTRACT

The invention has an object to provide a cold storage capable of simplifying a construction for pushing up a cooling unit and easily positioning a mounting position of the cooling unit. The cold storage includes a cooling unit integrated with a cooling box accommodating a cooler and a blower, and a compressor, a condenser and the like provided on a mounting base; a cold air discharge and a suction port formed in the bottom wall of a thermal insulating housing; fixing members having a stopper for positioning the cooling unit in a machine room such that a cold air discharge and a suction port correspond to lower sides of the first mentioned discharge and suction ports, respectively; and pushing-up members and operating arms for them, the pushing-up members causing the cooling unit to be pushed up toward the bottom wall of the thermal insulating housing by abutting against the lower surface of the mounting base on front and rear sides with respect to inserting direction of the cooling unit into the machine room.

13 Claims, 26 Drawing Sheets

COLD STORAGE

BACKGROUND OF THE INVENTION

The present invention relates to a cold storage incorporating a cooling unit including a compressor and a cooler under a thermal insulating housing constituting therein a storage room.

In a cold storage of this kind hitherto used as a low temperature showcase, a machine room is constructed under a storage room formed in a thermal insulating housing, and the bottom wall of the thermal insulating housing is formed with a cold air discharge port and a cold air suction port communicating with the machine room. A cooling box having openings in its upper surface is provided in the machine room so as to abut against the bottom wall of the thermal insulating housing, and a cooler and its blower constituting a cooling unit are arranged in the cooling box. Then, the interior of the storage room and the cooling box are communicated with each other through the cold air suction port and the cold air discharge port. Moreover, under the cooling box of the machine room, a compressor, a condenser, its blower and the like forming the cooling unit together with the cooler are arranged on a mounting base provided with casters on its bottom surface for moving, thereby constituting a publicly known cooling medium circuit.

The cooling box is also provided on the mounting base detachably from the bottom wall of the thermal insulating housing. The cooling box and the cooler, its blower, the compressor, the condenser and the like are freely admitted into or removed from the machine room together with the mounting base with the aid of the casters so that the cooling unit can be separated from the thermal insulating housing (refer to Japanese Patent Application Laid-Open No. 105, 058/2000).

In the prior art construction as described above, however, as cold air leakage would occur through clearances created between the openings of the upper surface of the cooling box and the cold air discharge and suction ports, after the mounting base has been admitted in the machine room, the cooling box having the cooler and its blower arranged therein must be lifted and fixed to the bottom wall of the thermal insulating housing by fixtures or the like. Therefore, the mounting operation would become complicated as a problem to be solved. At this time, moreover, the cooling box must be fixed in a position corresponding to the cold air discharge and suction ports formed in the bottom wall of the thermal insulating housing so that the positioning would become difficult, resulting in further deterioration of operationality. It may be envisioned that the cooling box is lifted together with the mounting base on which the cooling box is fixed and is then fixed to the bottom wall of the thermal insulating housing. However, as the compressor, the condenser and the like in addition to the cooling box are arranged on the mounting base, the total weight may be frequently more than 40 kg, it would be very troublesome to carry out the lifting operation every time maintenance operation is effected. Therefore, there has been a requirement for simple procedure for the mounting operation.

SUMMARY OF THE INVENTION

Accordingly, the invention has been completed to solve the technical problems of the prior art, and the invention has an object to provide a cold storage capable of pushing a cooling box against the bottom wall of a thermal insulating housing without any trouble by raising or pushing up a cooling unit integrated with a compressor, a condenser, a cooling box and the like, so that cold air produced by heat-exchanging in a cooler is delivered from a cold air discharge port into a storage room by a blower to obtain a cold air circulation from the cold air discharge port into a cooling chamber, thereby cooling the interior of the storage room. Particularly, the invention has an object to provide a cold storage capable of simplifying the construction for pushing up a cooling unit and easily positioning the location to which the cooling unit is mounted.

A first invention of the present application is directed to a cold storage including a thermal insulating housing, a storage room constructed in the thermal insulating housing, and a machine room constructed under the storage room, comprising a cooling unit integrated with a cooler and a blower accommodated in a cooling chamber constructed in a cooling box, and a compressor, a condenser and the like by providing them on a mounting base; a cold air discharge port and a cold air suction port which are formed in the bottom wall of the thermal insulating housing, the bottom wall being also a ceiling of the machine room, and communicate the interiors of the storage room and the machine room with each other; positioning means for positioning the cooling unit in the machine room such that the discharge side and the suction side of the cooling chamber correspond to the lower sides of the cold air discharge port and the cold air suction port; and pushing-up means for causing the cooling unit to be pushed up toward the bottom wall of the thermal insulating housing by abutting against the lower surface of the mounting base on its both sides or front and rear sides with respect to a direction inserting the cooling unit into the machine room.

A second invention of the present application is directed to the cold storage of the first invention, wherein the pushing-up means comprises pivotally movable pushing-up members provided respectively over from the front side to the rear side in the machine room at positions corresponding to both the sides of the cooling unit, and operating arms provided on the front side of the pushing-up members for pivotally moving the pushing-up members, and wherein the pushing-up members are pivotally moved in a direction pushing up the mounting base by causing the operating arms from their upright standing state to fall down toward the mounting base.

A third invention of the present application is directed to the cold storage of the second invention, wherein the operating arms in fallen down state are able to be fixed to the mounting base.

A fourth invention of the present application is directed to the cold storage of the first invention, wherein the pushing-up means comprises pivotally movable pushing-up members provided respectively over from the front side to the rear side in the machine room at positions corresponding to both the sides of the cooling unit, and operating arms provided on the front side of the pushing-up members for pivotally moving the pushing-up members, and wherein the pushing-up members are pivotally moved in a direction pushing up the mounting base by causing the operating arms from their fallen down state to stand upright onto the front side of the cooling unit.

A fifth invention of the present application is directed to the cold storage of the second, third or fourth invention, wherein the operating arms are each provided at its forward end with a handle portion extending onto front side.

A sixth invention of the present application is directed to the cold storage of the second, third, fourth or fifth invention, further comprising link means for interlocking the pushing-up members corresponding to both the sides of the cooling unit.

A seventh invention of the present application is directed to the cold storage of the first invention, wherein the pushing-up means comprises a pivotally movable rear pushing-up member provided in the machine room at a position corresponding to the rear side of the cooling unit, and pivotally movable front pushing-up members provided in the machine room at positions corresponding to the front side of the cooling unit, wherein by inserting the cooling unit into the machine room, the rear pushing-up member abuts against the mounting base to be pivotally moved in a direction pushing up the mounting base, and wherein by pivotally moving the front pushing-up members from the front side to the rear side, the mounting base is pushed up.

According to the first invention of the present application, the cold storage including a thermal insulating housing, a storage room constructed in the thermal insulating housing, and a machine room constructed under the storage room, comprises a cooling unit integrated with a cooler and a blower accommodated in a cooling chamber constructed in a cooling box, and a compressor, a condenser and the like by providing them on a mounting base; a cold air discharge port and a cold air suction port which are formed in the bottom wall of the thermal insulating housing, the bottom wall being also a ceiling of the machine room, and communicate the interiors of the storage room and the machine room with each other; positioning means for positioning the cooling unit in the machine room such that the discharge side and the suction side of the cooling chamber correspond to the lower sides of the cold air discharge port and the cold air suction port; and pushing-up means for causing the cooling unit to be pushed up toward the bottom wall of the thermal insulating housing by abutting against the lower surface of the mounting base on its both sides or front and rear sides with respect to a direction inserting the cooling unit into the machine room. Therefore, as it becomes possible to push up the cooling unit by the pushing-up means abutting against the lower surface of the cooling unit, the cooling unit is pushed up toward the thermal insulating housing to enable the cooling box to be pushed against the bottom wall of the thermal insulating housing.

In this manner, the cooling unit formed by integrating the compressor, the condenser, the cooling box and the like can be attached to the bottom wall of the thermal insulating housing without any trouble so that the cold air produced by heat-exchanging in the cooler is delivered from the cold air discharge port into the storage room by the blower to provide a cold air circulation from the cold air suction port into the cooling chamber, thereby enabling the interior of the storage room to be cooled.

Particularly, according to the constitution of the invention, the pushing-up means abuts against the lower surface of the cooling unit and then causes the cooling unit to be pushed up so that the cooling unit need not be provided with pushing-up means especially, thereby achieving reduction in cost and enhancing the versatility. Moreover, as the cold storage according to the invention comprises the positioning means, the position to be mounted can be defined when inserting the cooling unit into the machine room, thereby facilitating the mounting operation for the cooling unit.

Moreover, according to the second invention, in the above invention the pushing-up means comprises pivotally movable pushing-up members provided respectively over from the front side to the rear side in the machine room at positions corresponding to both the sides of the cooling unit, and operating arms provided on the front side of the pushing-up members for pivotally moving the pushing-up members, and further the pushing-up members are pivotally moved in a direction pushing up the mounting base by causing the operating arms from their upright standing state to fall down toward the mounting base. Therefore, the cooling unit can be easily pushed up toward the bottom wall of the thermal insulating housing. Particularly, the operating arms are actuated in a manner lowering them from above to below so that the pushing-up members can be pivotally moved in the direction enabling the mounting base to be pushed up, thereby improving the operationality and enabling the cooling unit to be pushed up with ease.

Further, when the operating arms are in the fallen down state, the cooling unit will come into the pushed up state, and at this time the operating arms are positioned in front of the cooling unit. Consequently, the forward movement of the cooling unit can be impeded by means of the operating arms. In this manner, positioning of the cooling unit can be readily effected so that the mounting operation for the cooling unit can be simplified.

Moreover, according to the third invention, in the above second invention the operating arms in their fallen down state are able to be fixed to the mounting base. Accordingly, the cooling unit can be fixed by means of the operating arms so that it becomes possible to preventively avoid the degrading of the sealing performance between the cooling box and the thermal insulating housing due to pivotal movement of the pushing-up members caused by the own weight of the cooling unit.

According to the fourth invention, in the above first invention the pushing-up means comprises pivotally movable pushing-up members provided respectively over from the front side to the rear side in the machine room at positions corresponding to both the sides of the cooling unit, and operating arms provided on the front side of the pushing-up members for pivotally moving the pushing-up members, and further the pushing-up members are pivotally moved in a direction pushing up the mounting base by causing the operating arms from their fallen down state to stand upright onto the front side of the cooling unit. Therefore, the cooling unit can be easily pushed up toward the bottom wall of the thermal insulating housing.

Particularly, as the operating arms are in the fallen down state when inserting the cooling unit into the machine room, it is possible to eliminate the disadvantage that the operating arms may interface with the inserting operation of the cooling unit, thereby improving the operationality. Moreover, by arranging the pushing-up members on both the sides at a smaller distance from each other, a miniaturization of the pushing-up means can be realized.

Further, according to the fifth invention, the operating arm in the second, third or fourth invention are each provided at its forward end with a handle portion extending to front side, thereby improving the operationality of the operating arms to enable the pivotal movement to be easily effected.

Moreover, according to the sixth invention, there are further provided with link means for interlocking the pushing-up members corresponding to both the sides of the cooling unit in the second, third, fourth or fifth invention, thereby enabling the pushing-up members on both the sides to be simultaneously operated and hence enabling the pushing-up operation to be performed in a simple manner.

Furthermore, according to the seventh invention, in the above first invention the pushing-up means comprises a pivotally movable rear pushing-up member provided in the machine room at a position corresponding to the rear side of the cooling unit, and pivotally movable front pushing-up members provided in the machine room at positions corresponding to the front side of the cooling unit, further by inserting the cooling unit into the machine room, the rear pushing-up member abuts against the mounting base to be pivotally moved in a direction pushing up the mounting base, and further by pivotally moving the front pushing-up members from the front side to the rear side, the mounting base is pushed up. Accordingly, it becomes possible to push up the cooling unit toward the bottom wall of the thermal insulating housing with ease. According to this invention, particularly, by inserting the cooling unit into the machine room, the rear side of the cooling unit is pushed up by the rear pushing-up member and thereafter the front side of the cooling unit is pushed up by the front pushing-up members.

In this case, the cooling unit is pushed up by pivotally moving the front pushing-up members from the front side to rear side, that is, the rear pushing-up member is pivotally moved in the direction pushing up the cooling unit and also the front pushing-up members are pivotally moved to push up the cooling unit so that positional shifting of the cooling unit back and forth and dislodgement of the cooling unit from the rear pushing-up member do not occur, thereby enabling the cooling unit to be pushed up toward the bottom wall of the thermal insulating housing with a great stability.

DETAILED DESCRIPTION OF THE PREFERRED EMBODIMENT

Figure 1:
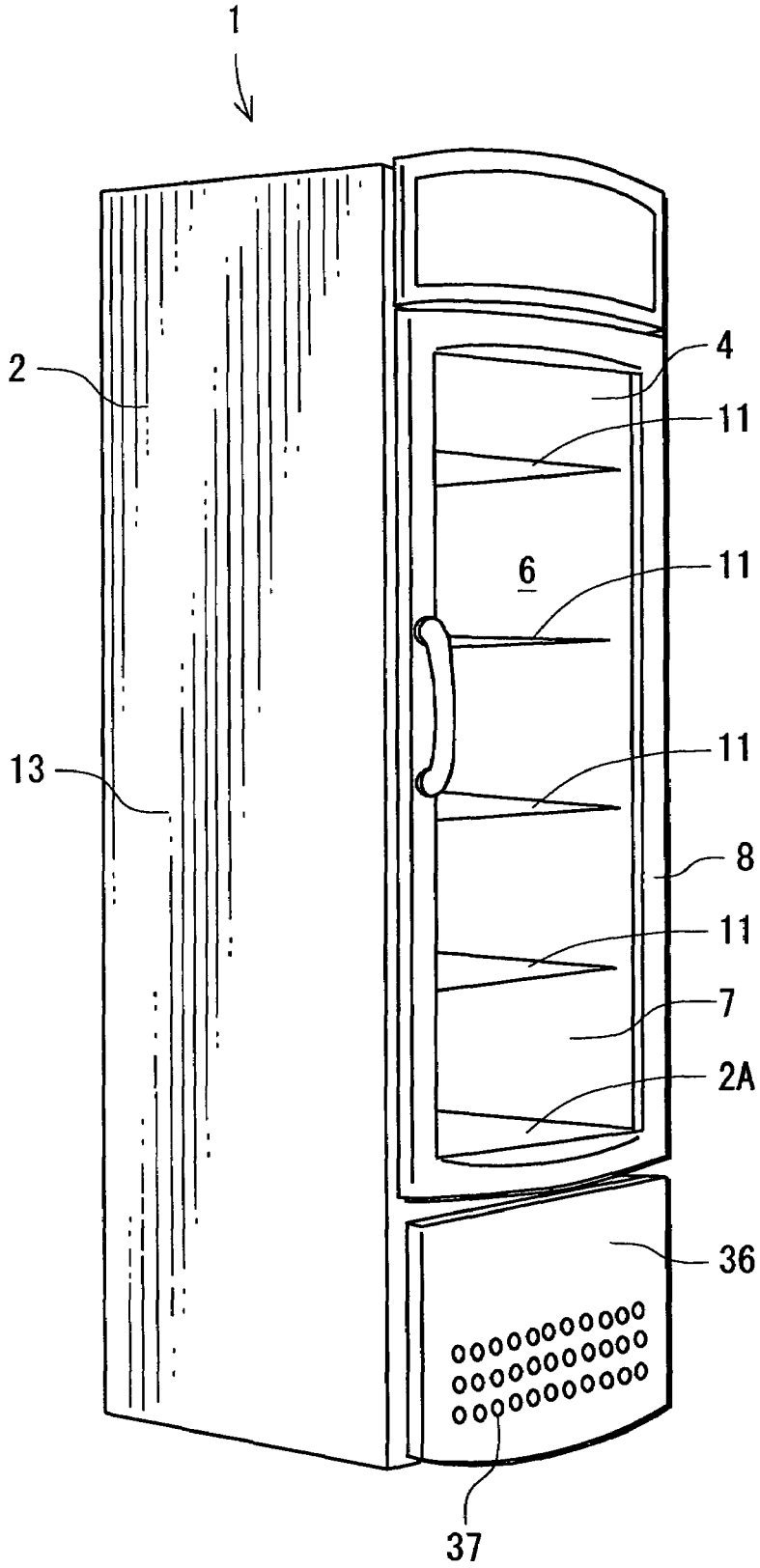
FIG. 1 is a perspective view of a cold storage to which the present invention is applied (embodiment 1)
Figure 2:
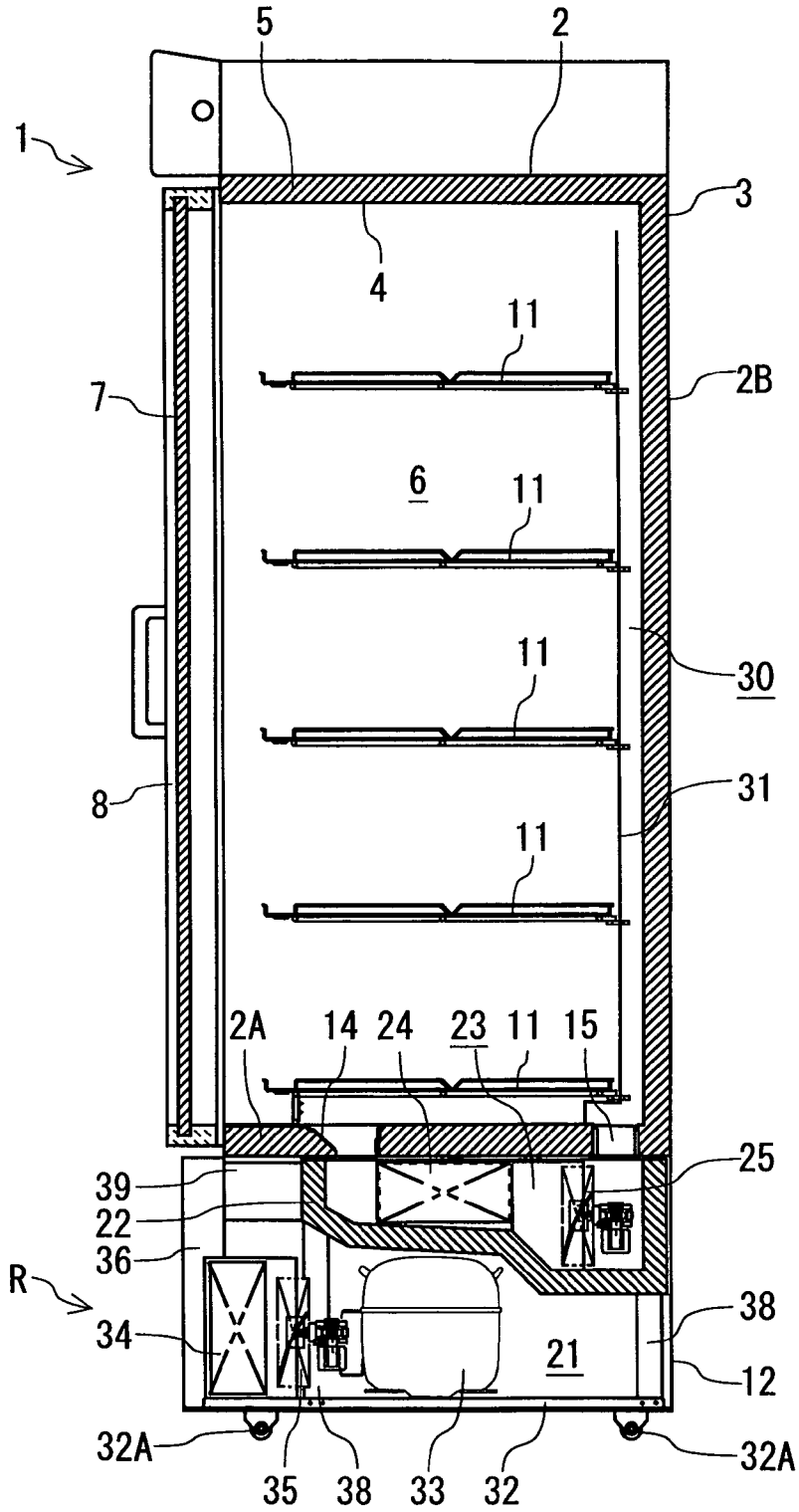
FIG. 2 is a longitudinal sectional view of the cold storage of FIG. 1 (embodiment 1)
Figure 3:
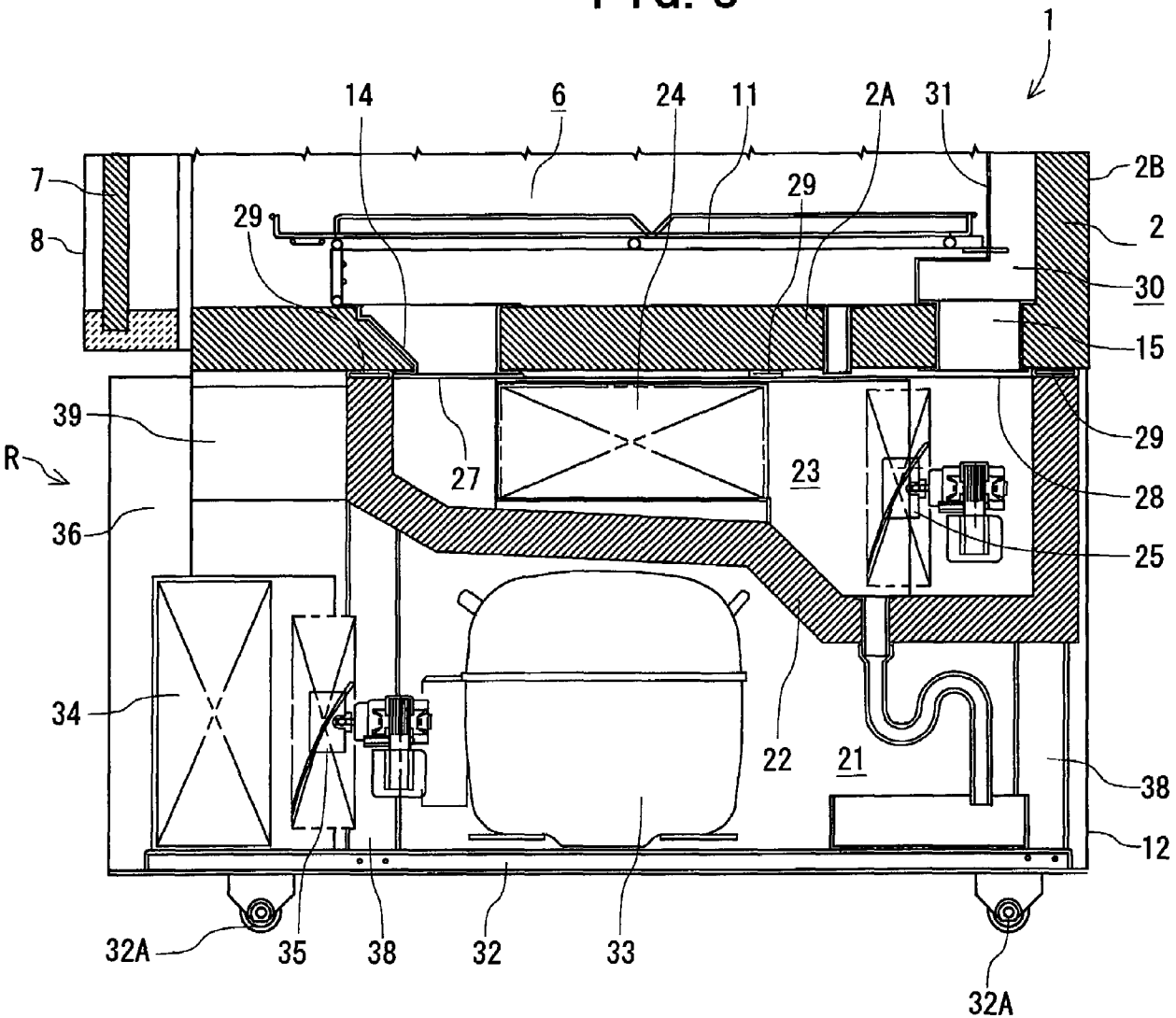
FIG. 3 is an enlarged longitudinal sectional side view of the lower part of the cold storage of FIG. 2 (embodiment 1)
Figure 4:
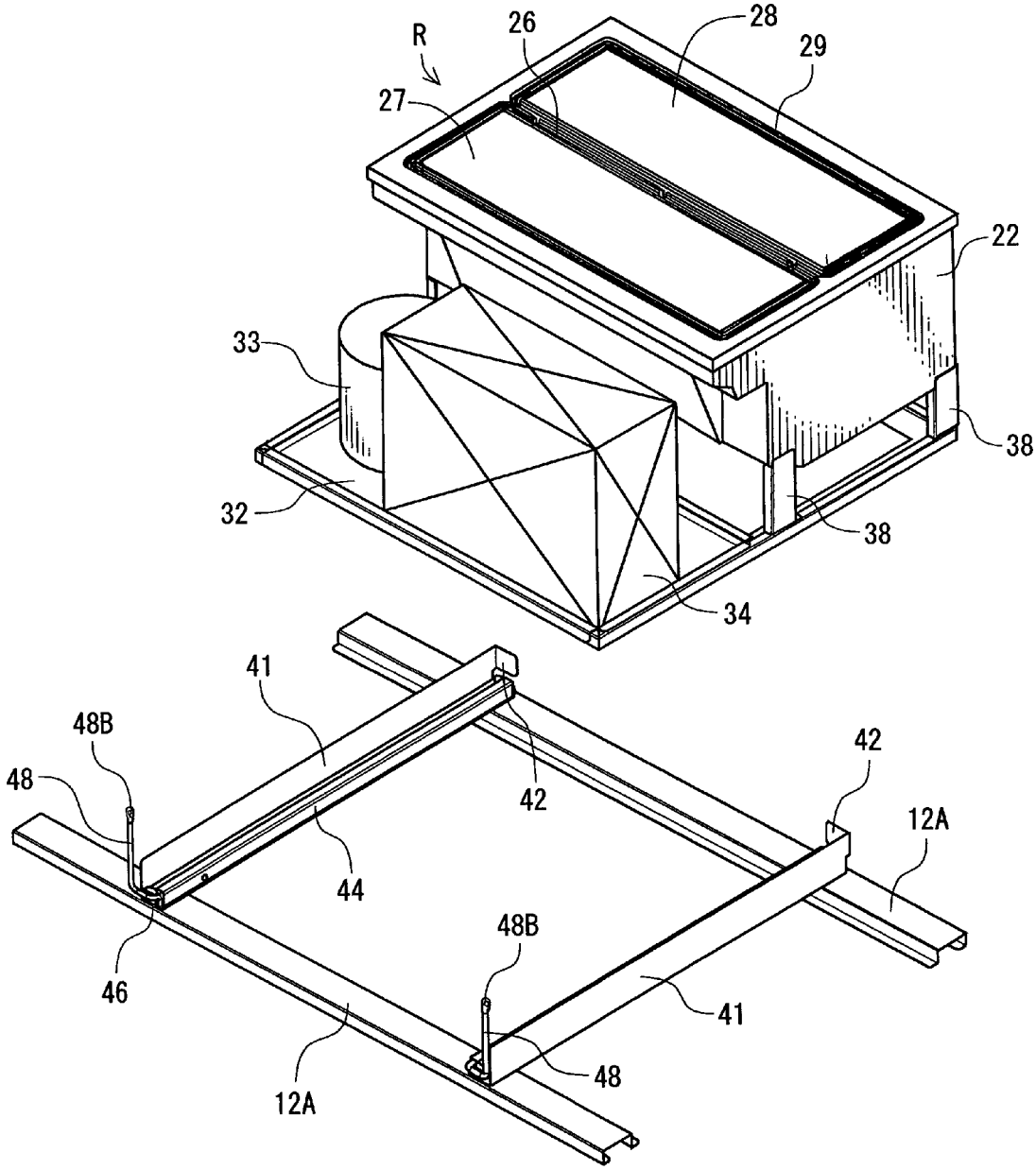
FIG. 4 is a perspective view of a cooling unit and a pushing-up mechanism (embodiment 1)
Figure 5:
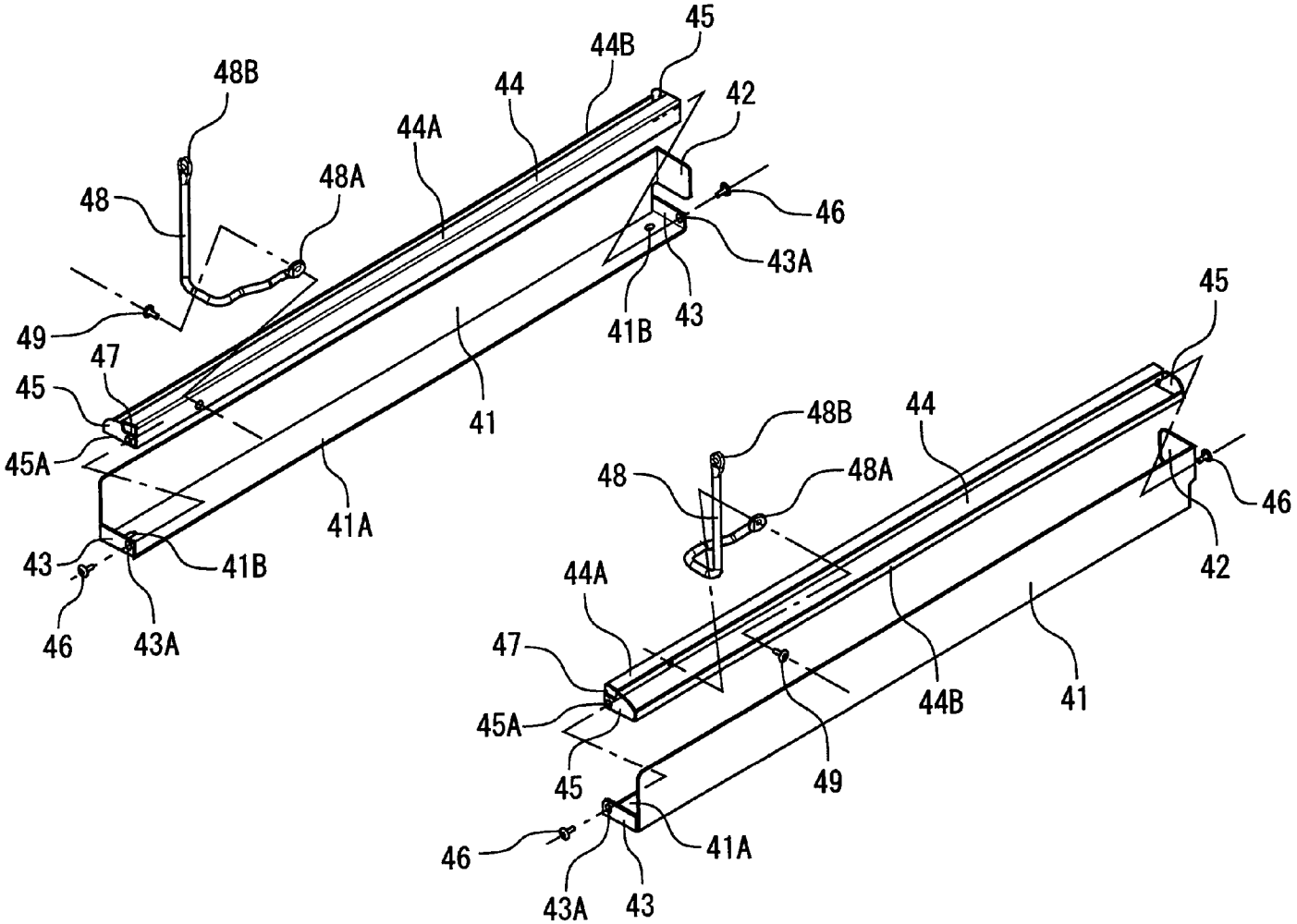
FIG. 5 is an exploded perspective view of the pushing-up mechanism (embodiment 1)

Configuration for carrying out the invention will be explained in detail with reference to the drawings hereinafter.

Embodiment 1

First, the cold storage 1 of the first embodiment of the invention will be explained in detail with reference to FIGS. 1 to 11.

The cold storage 1 of the embodiment includes a main body constructed by a rectangular thermal insulating housing 2 forward opening. The thermal insulating housing 2 comprises an outer case 3 made of steel plates and having an opening in its front face, an inner case 4 having an opening in its front face, and a thermal insulating material 5 filled by foaming between the inner and outer cases 4 and 3. Formed in the thermal insulating housing 2 is a storage room 6 opening in its front face, and the front opening of the storage room is closed to be openable and closable by a door 8 having a glass 7 through which the interior of the storage room 6 is visible. The door 8 is pivotally mounted with its one side end onto the side of the thermal insulating housing 2 as a hinged door. A plurality of shelf boards 11 are arranged in the storage room 6 for loading food products and the like thereon.

Secured to the bottom surface of the thermal insulating housing 2 are base leg angles 12 having a predetermined height, whose both the side faces are covered together with both the side faces of the thermal insulating housing 2 by decorative panels 13, thereby forming a machine room 21 under the thermal insulating housing 2. Moreover, a pair of fixing members 41, 41 later described in detail are mounted onto front and rear lower sides 12A, 12A of the base leg angles 12 forming the bottom portion of the machine room 21. Further, the bottom wall 2A of the thermal insulating housing 2 is formed with a cold air suction port 14 and a cold air discharge port 15 on front and rear sides in a manner passing through the thermal insulating material 5.

A cooling box 22 having an opening in its upper surface is provided so as to abut against the lower surface of the bottom wall 2A of the thermal insulating housing 2, the bottom wall 2A forming a ceiling of the machine room 21. The cooling box 22 forms therein a cooling chamber 23 in which there are arranged a cooler 24 forming a cooling device and in front of it a blower 25 for the cooler. Moreover, at the opening in the upper surface of the cooling box 22, a cold air suction port 27 and a cold air discharge port 28 on the side of the cooling box 22 are formed by providing a partition board 26 as shown in a perspective view of a cooling unit R in FIG. 4. These cold air suction port 27 and the cold air discharge port 28 correspond to the cold air suction port 14 and the cold air discharge port 15 formed in the bottom wall 2A of the thermal insulating housing 2, respectively. Attached to the margins of the openings of the cooling box 22 are seal members 29 which closely abut against the lower surface of the bottom wall 2A of the thermal insulating housing 2. Moreover, a construction for closely fixing the upper surface of the cooling box 22 to the lower surface of the bottom wall 2A of the thermal insulating housing 2 will be described in detail later.

On the other hand, partition plates 31 are secured inside a rear wall 2B of the thermal insulating housing 2 so that the partition plates 31 constitute a duct 30 communicating the cold air discharge port 15 formed in the bottom wall 2A with the upper portion of the storage room 6. The partition plates 31 are formed with a plurality of openings (not shown) for supplying the cold air delivered from the blower 25 of the cooler, thereby effectively supplying the cold air into the storage room 6. Furthermore, the partition plates 31 may be formed with latching parts for latching the shelf boards 11.

On the one hand, a mounting base 32 constituting the bottom of the cooling unit R is enclosed in the machine room 21, and there are provided on the mounting base 32 a compressor 33, a condenser 34, a blower 35 for the condenser, a control box 39 and the like, which are forming the cooling device together with the cooler 24. Casters 32A are secured to the four corners of the mounting base 32. Further, the casters 32A are shown only in FIGS. 2 and 3. Moreover, an openable and closable panel 36 is attached to the front face of the machine room 21 for concealing the machine room 21. Also, the panel 36 is formed with a plurality of vent holes 37 corresponding to the front of the condenser 34.

In this case, the cooler 24 in the cooling box 22 is connected to the compressor 33, the condenser 34 and the like on the mounting base 32 by means of cooling medium piping to form a cooling medium circuit which is publicly known. Also, the cooling box 22 is detachably held by cooling box supporting means 38 and the like provided at positions corresponding to four corners of the lower surface of the cooling box 22. In this manner, the cooling unit R comprising the cooling box 22, the cooler 24, the blower 25 for the cooler, the compressor 33, the condenser 34 and the like together with the mounting base 32 can be stored in or removed from the machine room 21 so that they can be separated from the thermal insulating housing 2.

A pushing-up structure for the cooling unit R will then be explained with reference to FIGS. 4 to 11.

The pushing-up structure for raising or pushing up the cooling unit R together with the mounting base 32 toward the bottom wall 2A comprises a pair of fixing members 41, 41, a pair of pushing-up members 43, 43, and operating arms 48, 48 for pivotally moving the pushing-up members 43. Also, pushing-up means comprises the pushing-up members 43 and the operating arms 48.

The fixing members 41, 41 extend on both the sides of the cooling unit R from front to rear when the cooling unit R is in the machine room, that is, from the front side to the rear side of the machine room 21 and have a substantially L-shaped cross-section opening toward the interior of the machine room 21. The fixing members 41 are each formed with engaging apertures 41B, 41B at front and rear ends of the bottom surface 41A. The fixing members 41 are fixed to the base leg angles 12 by tightening these members as by set screws passing through the engaging apertures 41B and engaging apertures (not shown) which are previously formed in the lower members 12A of the base leg angles 12 at front and rear sides and brought into alignment with the engaging apertures 41B.

The fixing members 41 are each formed at a rear end of the side surface with a stopper (positioning means) 42 which is bent substantially at right angles and extending toward the interior of the machine room 21. Further, the fixing members 41 are each formed at the front and rear ends of the bottom surface with flanges 43 which are bent upward substantially at right angles. The flanges 43 are each formed with an engaging hole 43A for receiving a pivot shaft 46 for pivotally mounting the front and rear ends of a pushing-up member 44.

The pushing-up members 44 are constructed from the forward ends to the rear ends of the fixing members 41 or from the front side to the rear side of the machine room 21 and are mounted on the flanges inside the fixing members 41 so as to be pivotally movable about the pivot shafts 46. When the pushing-up members 44 are in fallen down state or in substantially horizontal position, the pushing-up members 44 have a substantially L-shaped cross-section opening toward the fixing members 41. In such a state, the pushing-up members 44 are formed at upper ends and side ends with horizontal surfaces 44A and 44B inwardly bent at right angles, respectively. In the fallen down state, the pushing-up members 44 are formed at the forward and rear ends with cam surfaces 45 upwardly bent substantially at right angles. The cam surfaces 45 are each formed at an inner corner with an engaging hole 45A for pivotally mounting the pushing-up member on the pivot shaft 46 passing through the engaging hole 45A and the engaging hole 43A of the flange 43.

Figure 8:
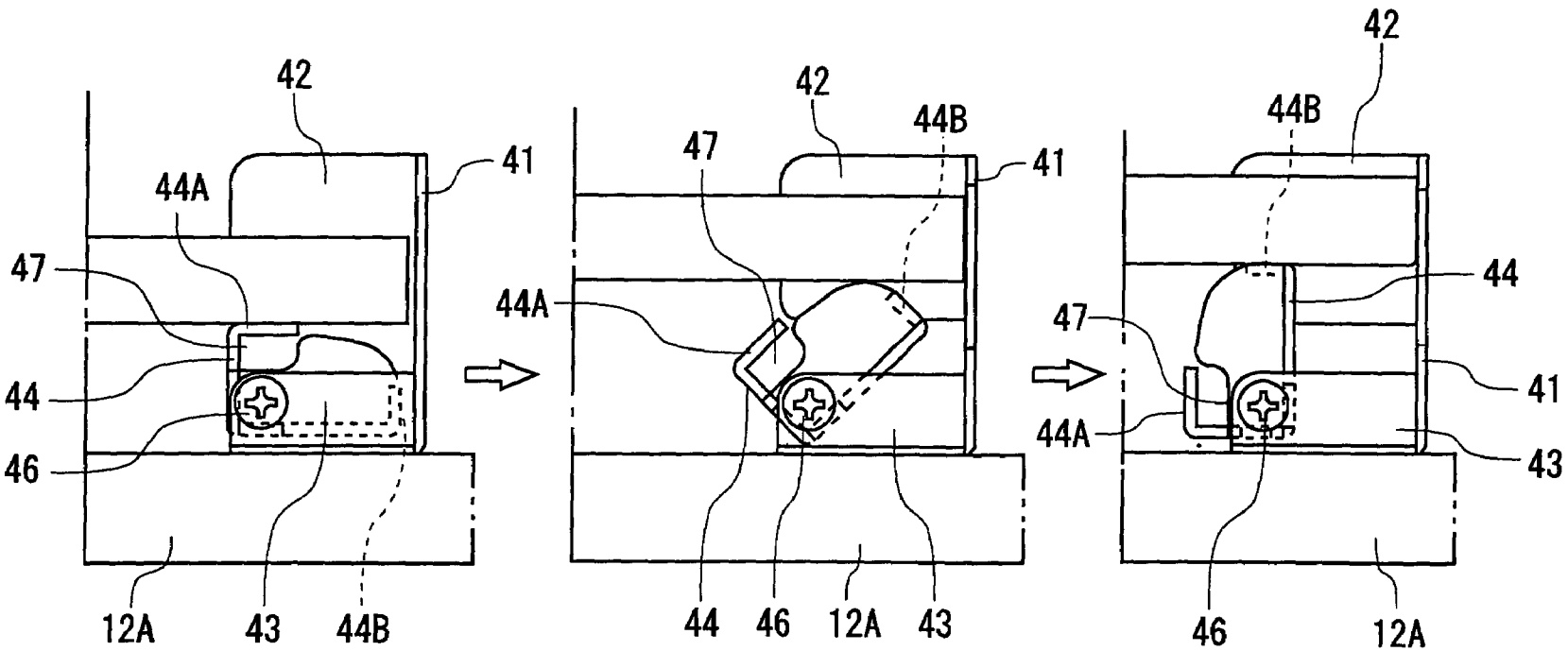
FIG. 8 is a view illustrating pivoting states of the pushing-up member (embodiment 1)

The horizontal surfaces 44A abut against the lower surface of the mounting base 32 at its both sides in the state that the cooling unit R is accommodated in the machine room 21. The cam surfaces 45 are each formed in a manner that its radius from the pivot shaft 46 becomes progressively larger on proceeding of the pivotal movement of the pushing-up member 44 about the pivot shaft 46 inwardly of the machine room 21. Consequently, starting from the state that the mounting base 32 is arranged on the horizontal surfaces 44A which are the uppermost surfaces of the pushing-up members 43 in the fallen down state as shown at the left of FIG. 8, the pushing-up members 43 are pivotally moved about the pivot shafts 46 inwardly of the machine room 21 (shown at the center of FIG. 8) and further to the upright standing state (shown at the right of FIG. 8). The abutting surfaces of the cam surfaces 45 against the mounting base 32 are changed from the horizontal surfaces 44A to edges of the cam surfaces 45 further to the horizontal surfaces 44B so that the mounting base 32 arranged on the pushing-up members 44 is pushed up by the increase of the radius of the cam surfaces 45.

Moreover, there are no cam surfaces between the cam surfaces 45 at the forward and rear ends of the pushing-up members 44. However, by providing the horizontal surfaces 44A and 44B, the mounting base 32 can be held in a stable condition, in the state that the pushing-up members are fallen down or stand upright. In other words, in the state that the pushing-up members 44 are fallen down, the lower surface of the mounting base 32 can be stably held by the horizontal surfaces 44A, and during the pivotal movement of the pushing-up members about the pivot shafts 46, the lower surface of the mounting base 32 is also stably held by the edges of the cam surfaces 45. Further, in the state that the pushing-up members 44 stand upright, the lower surface of the mounting base 32 is also stably held by the horizontal surfaces 44B under the condition the mounting base 32 is pushed up.

Moreover, the cam surfaces 45 of the pushing-up members 44 are each formed with an inserting hole 47 between the horizontal surface 44A and the edge of the cam surface. The operating arm 48 is inserted into the inserting hole 47, and the end of the operating arm 48 positioned inwardly of the pushing-up member 44 is fixed to the pushing-up member 44 so that the operating arm 48 is mounted in position.

The operating arms 48 are bar-shaped members made of a metallic material and are each formed with a mounting hole 48A at one end for fixing the operating arm to the pushing-up member 44 and a fixing hole 48B at the other end for fixing the operating arm to the forward end of the mounting base 32 for the cooling unit R. Further, this operating arm 48 extends from its one end of the mounting hole 48A to the forward end of the pushing-up member 44 and then is bent substantially at right angles in front of the pushing-up member 44 toward the side face of the fixing member 41. Moreover, the remaining part of the operating arm 48 to the other end of the fixing hole 48B is bent upwardly substantially at right angles.

Figure 6:
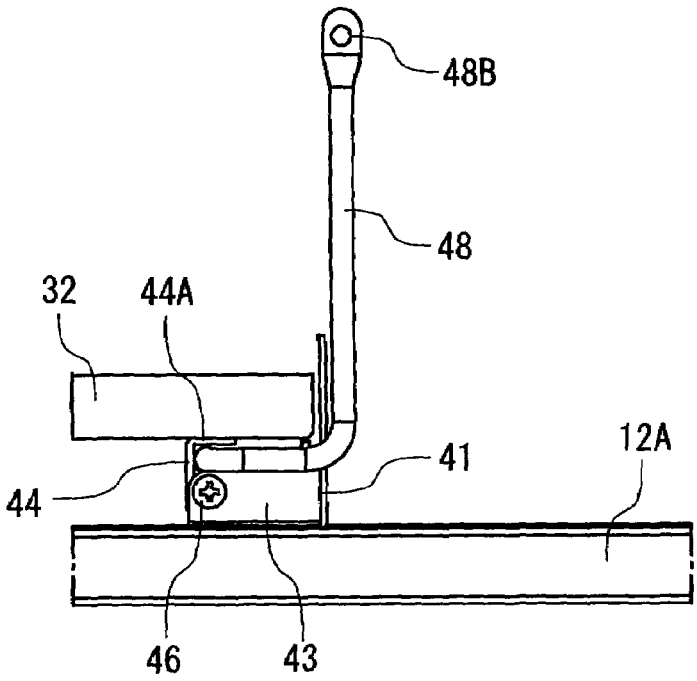
FIG. 6 is a partly enlarged front view of the pushing-up mechanism in lowered state (embodiment 1)
Figure 7:
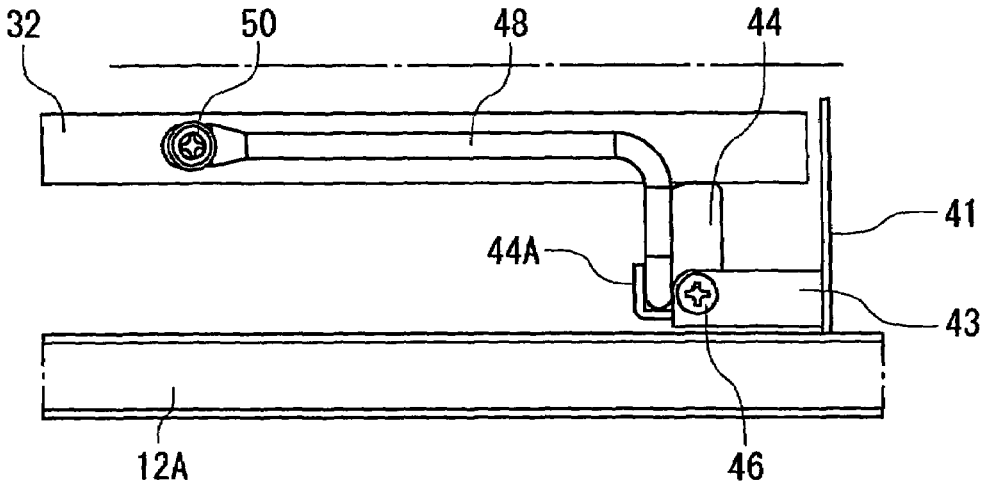
FIG. 7 is a partly enlarged front view of the pushing-up mechanism in pushed up state (embodiment 1)

The mounting hole 48A of the operating arm 48 is fixed to the side face of the pushing-up member 44 in the fallen down state and positioned inwardly of the machine room 21 by means of a screw 49, whereby the end of the operating arm 48 on the side of the fixing hole 48A stands upright in the state that the pushing-up member 44 is fallen down. At this time, the upright standing operating arm 48 is flush with or slightly outwardly of the side surface of the fixing member 41 as shown in FIG. 6 in order to avoid the operating arm 48 from contacting the mounting base 32 when inserting the mounting base 32 for the cooling unit R.

Figure 9:
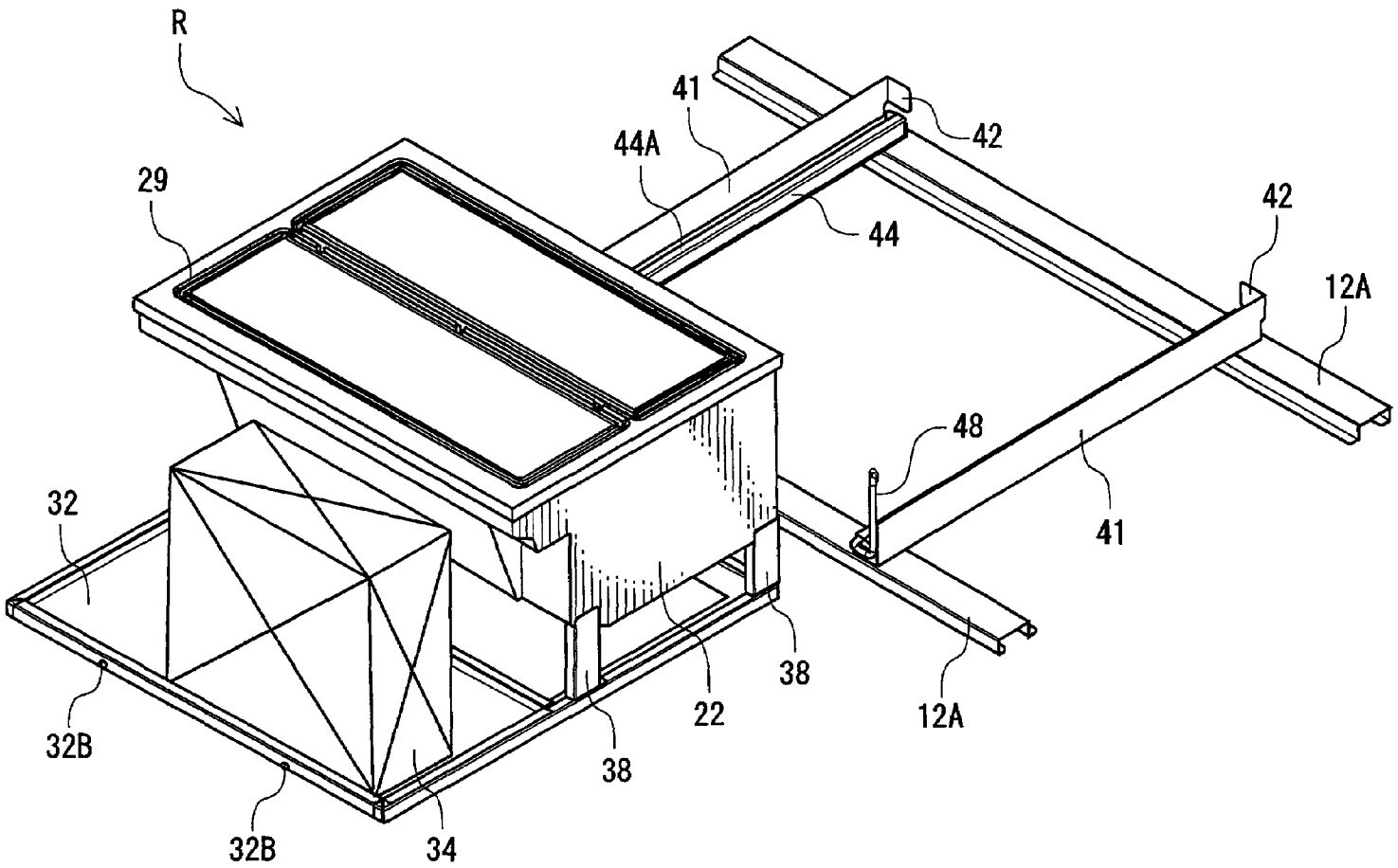
FIG. 9 is a perspective view of the cooling unit before inserting onto the pushing-up mechanism (embodiment 1)
Figure 10:
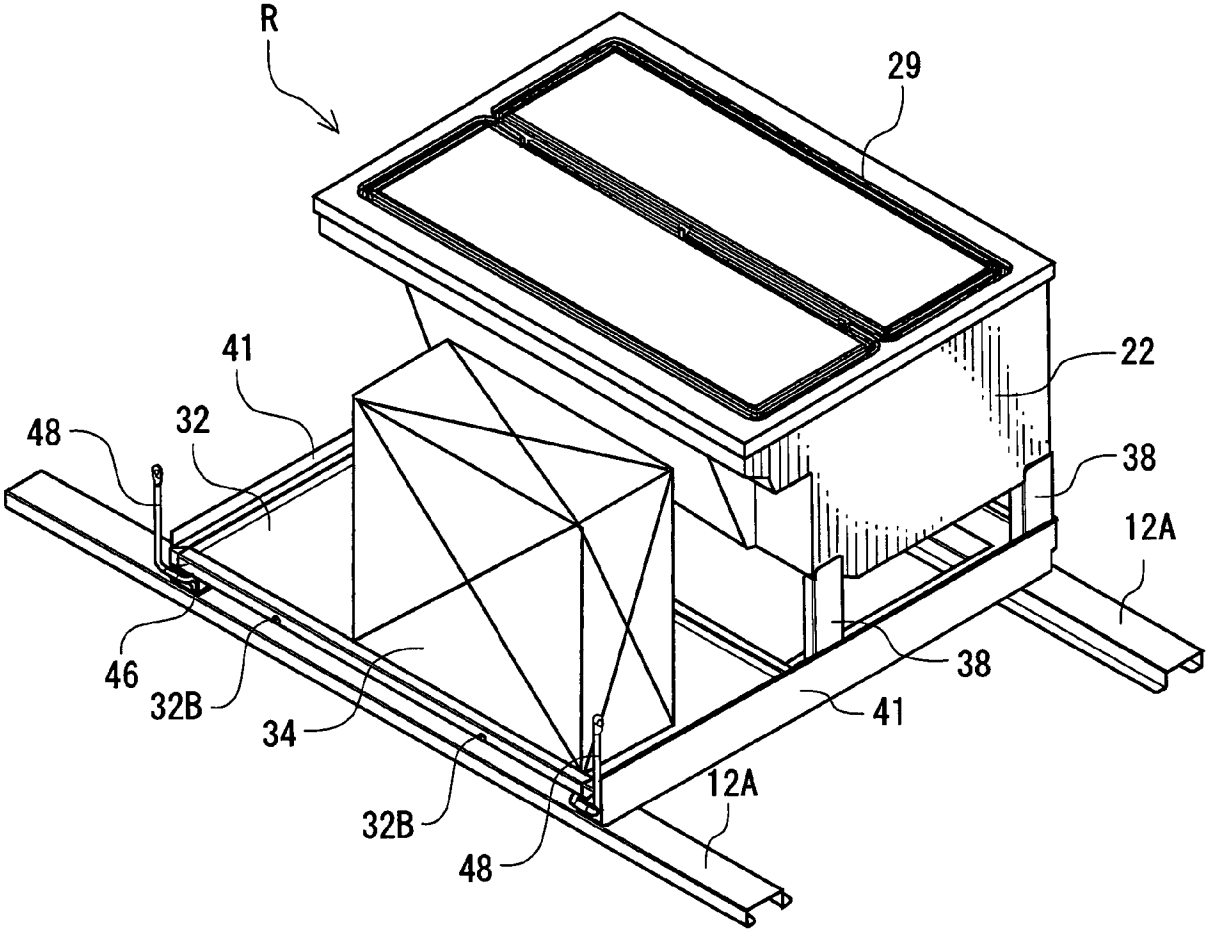
FIG. 10 is a perspective view of the cooling unit inserted onto the pushing-up mechanism (before being pushed up) (embodiment 1)
Figure 11:
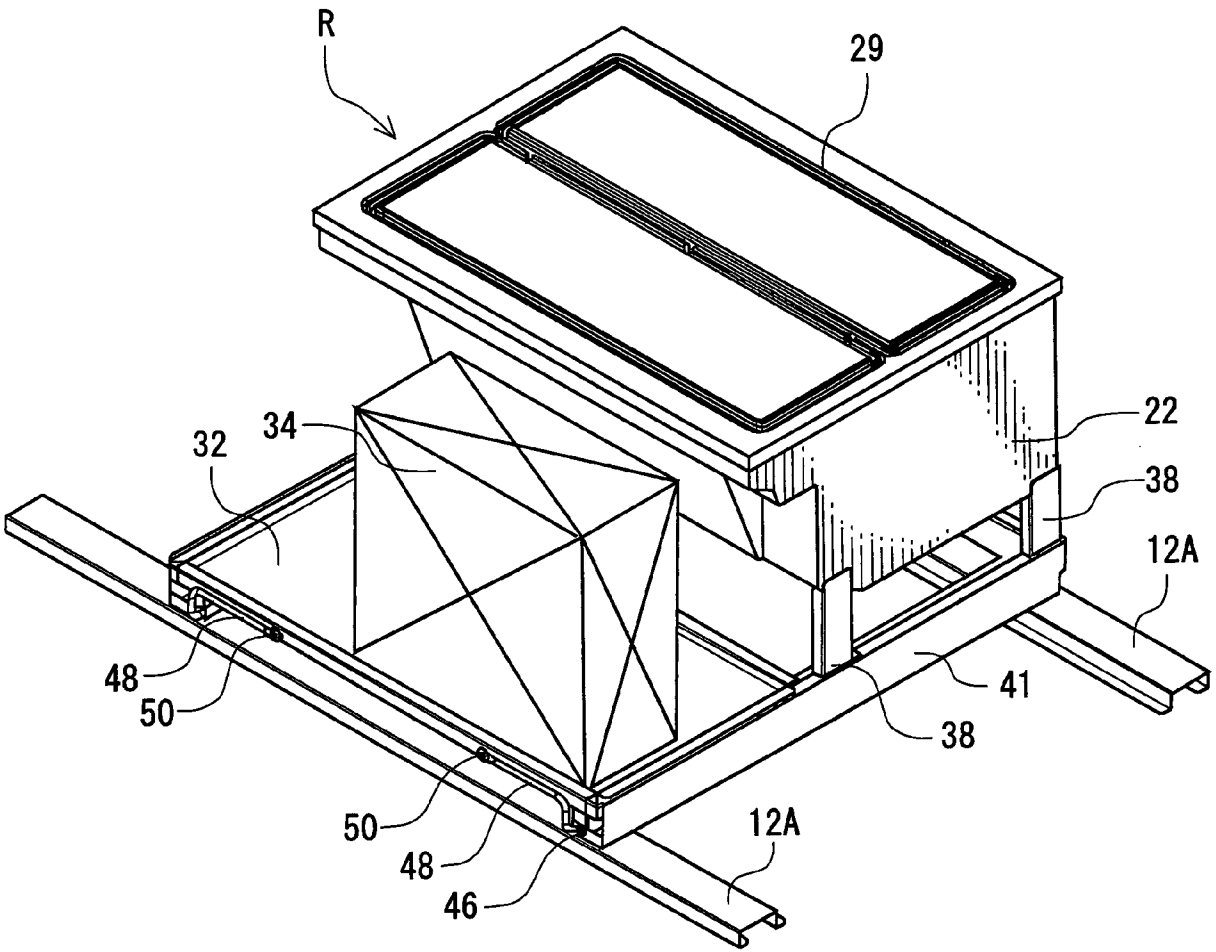
FIG. 11 is a perspective view of the cooling unit pushed up by the pushing-up mechanism (embodiment 1)

According to the construction as discussed above, the mounting base 32 for the cooling unit R as described above is admitted into the machine room 21 from its front side as shown in FIG. 9. At this time, the mounting base 32 is positioned with respect to the lateral direction by the side faces of both the fixing members 41, 41 fixed to lower members 12A of the base leg angles 12 at front and rear sides. The side ends of the lower surface of the mounting base 32 at both the sides are caused to abut against the upper surfaces of the horizontal surfaces 44A of the pushing-up members 44 mounted inwardly of the fixing members 41, and the mounting base 32 is slidably moved inwardly until it abuts against stoppers 42 formed at the rear ends of the fixing members 41 so that the mounting base 32 is inserted in the machine room 21 as shown in FIG. 10.

In this manner, the cold air suction port 27 and the cold air discharge port 28 formed in the cooling box 22 of the cooling unit R can be accurately positioned correspondingly to the lower ends of the cooling air suction port 14 and the cooling air discharge port 15 formed in the bottom wall 2A of the thermal insulating housing 2. Thus, the mounting operation is simplified, and leakage of the cold air due to shifting of the mounting base 32 back and forth after being fixed can be restrained.

Moreover, under the condition that the cold air suction port 27 and the cold air discharge port 28 of the cooling box 22 are below the cold air suction port 14 and the cold air discharge port 15 of the bottom wall 2A of the thermal insulating housing 2, the operating arms 48 mounted on both the sides as described above are operated to be fallen down inwardly of the machine room 21 so that the pushing-up members 44 to which the operating arms 48 are fixed are pivotally moved about the pivot shafts 46 as discussed above. As a result, the mounting base 32 is pushed up by the variation in radius of the cam surfaces 45 of the pushing-up members 44 from the pivot shafts 46. Therefore, the cooling box 22 fixed to the mounting base 32 is also pushed up so that the openings of the upper surface of the cooling box 22 can be brought into abutment against the lower surface of the bottom wall 2A of the thermal insulating housing 2. At this time, as the seal members 29 have been attached to the margins of the openings of the cooling box 22 as described above, the openings of the upper surface of the cooling box 22 can be hermetically pushed to the bottom wall 2A with the expansion and contraction of the seal members 29.

Therefore, the cooling unit R composed of an integrated combination of the compressor 33, the condenser 34, cooling box 22 and the like can be secured to the bottom wall 2A of the thermal insulating housing 2 without any objection so that the cold air which has been heat-exchanged with the cooler 24 is delivered by the blower 25 of the cooler from the cold air discharge port 15 into the storage room 6 and further drawn from the cold air suction port 14 into the cooling chamber 23, thereby forming an cold air circulation enabling the interior of the storage room 6 to be cooled. Particularly, the ends of the lower surface of the mounting base 32 for the cooling unit R are loaded on the pushing-up members 44, and the operating arms 48 are caused to fall down from their upright standing state so that the mounting base 32 can be fixed in the pushed up condition, thereby facilitating the mounting operation of the cooling unit R.

In one arrangement, moreover, the pushing-up members 44 are brought into abutment against the lower surface of the mounting base 32 of the cooling unit R, and the operating arms 48 are actuated to push up the cooling unit R, thereby achieving a reduction in cost because of no need for particularly constituting a pushing-up structure on the side of the cooling unit R. Further, by mounting the fixing members 41 and the pushing-up members 44 onto the angles 12 of the machine room 21, the pushing-up mechanism can be constructed so that various cooling units R may be accommodated and hence the versatility can be enhanced.

According to the embodiment of the invention, furthermore, as the stoppers 42 are provided at the rear ends of the fixing members 41 as positioning means, mounting position can be defined when the cooling unit R is inserted into the machine room 21, thereby facilitating the mounting operation. By causing the operating arms 48 to fall down, the cooling unit R is forced into the pushed up state, and at this moment, the operating arms 48 are positioned forwardly of the mounting base 32 so that the forward movement of the cooling unit R can be impeded by the operating arms 48. Therefore, the cooling unit R can be easily positioned, thereby achieving simplification of the mounting operation. Moreover, the forward and rearward movement of the cooling unit R in the fixed state can be securely restricted so that the cooling unit R can be stably fixed.

Moreover, the operating arms 48 in their fallen down state are positioned at the forward end of the mounting base 32 which is pushed up, and the operating arms 48 are fixed to the mounting base 32 by means of the screws 50 passing through the fixing holes 48B formed in the operating arms 48 and the fixing holes 32B previously formed in the forward end of the mounting base 32 and brought into alignment with the fixing holes 48B of the operating arms, thereby avoiding problematical lowering of the mounting base 32 due to the own weight of the cooling unit R.

Further, by actuating the operating arms 48 in a manner lowering them downwardly from the above, the pushing-up members 44 can be pivotally moved in the direction pushing up the mounting base 32 so that good operationality can be obtained, and the cooling unit R can be readily pushed up.

Figure 12:
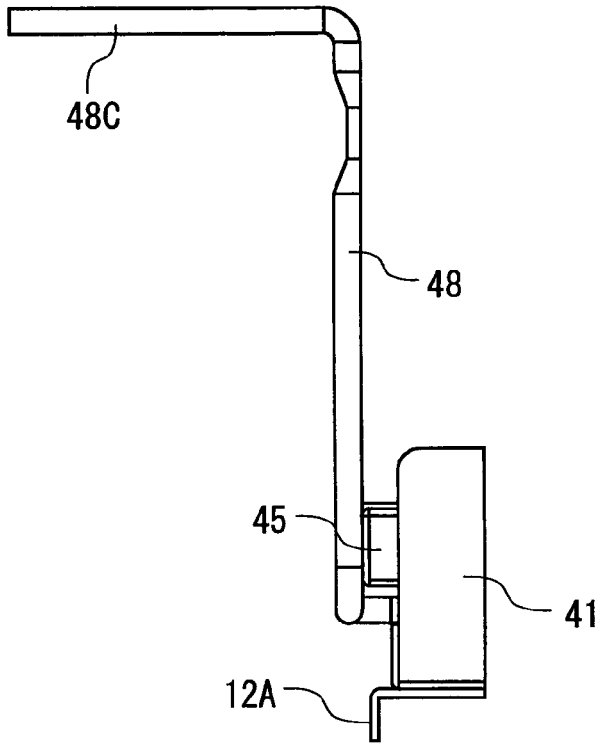
FIG. 12 is a partly enlarged side view of the operating arm in upright standing state (embodiment 1)
Figure 13:
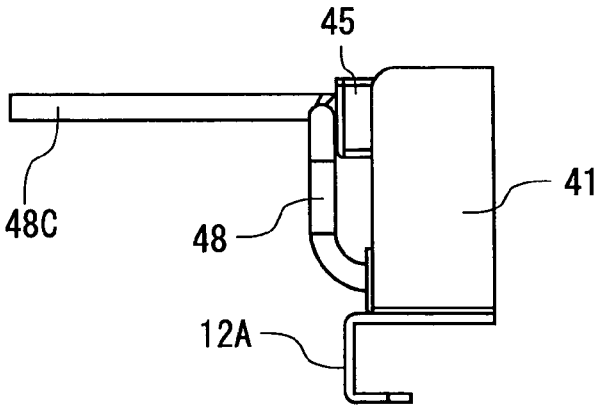
FIG. 13 is a partly enlarged side view of the operating arm in fallen down state (embodiment 1)

As shown in the partly enlarged side view of the operating arm 48 standing upright of FIG. 12 and in the partly enlarged side view of the operating arm 48 fallen down of FIG. 13, the forwardly extending handle portion 48C may be constructed by bending the upper end of the operating arm 48 substantially at right angles onto the front side, thereby more improving the operationality of the operating arms to facilitate the operation for the pivotal movement. As the handle portion 48C of the operating handle 48 extends toward the front side, it becomes possible to avoid the risk that fingers of hands may come into contact with the condenser 34, the compressor 33 and the like arranged in the forward portion of the cooling unit R when operating.

Embodiment 2

Figure 14:
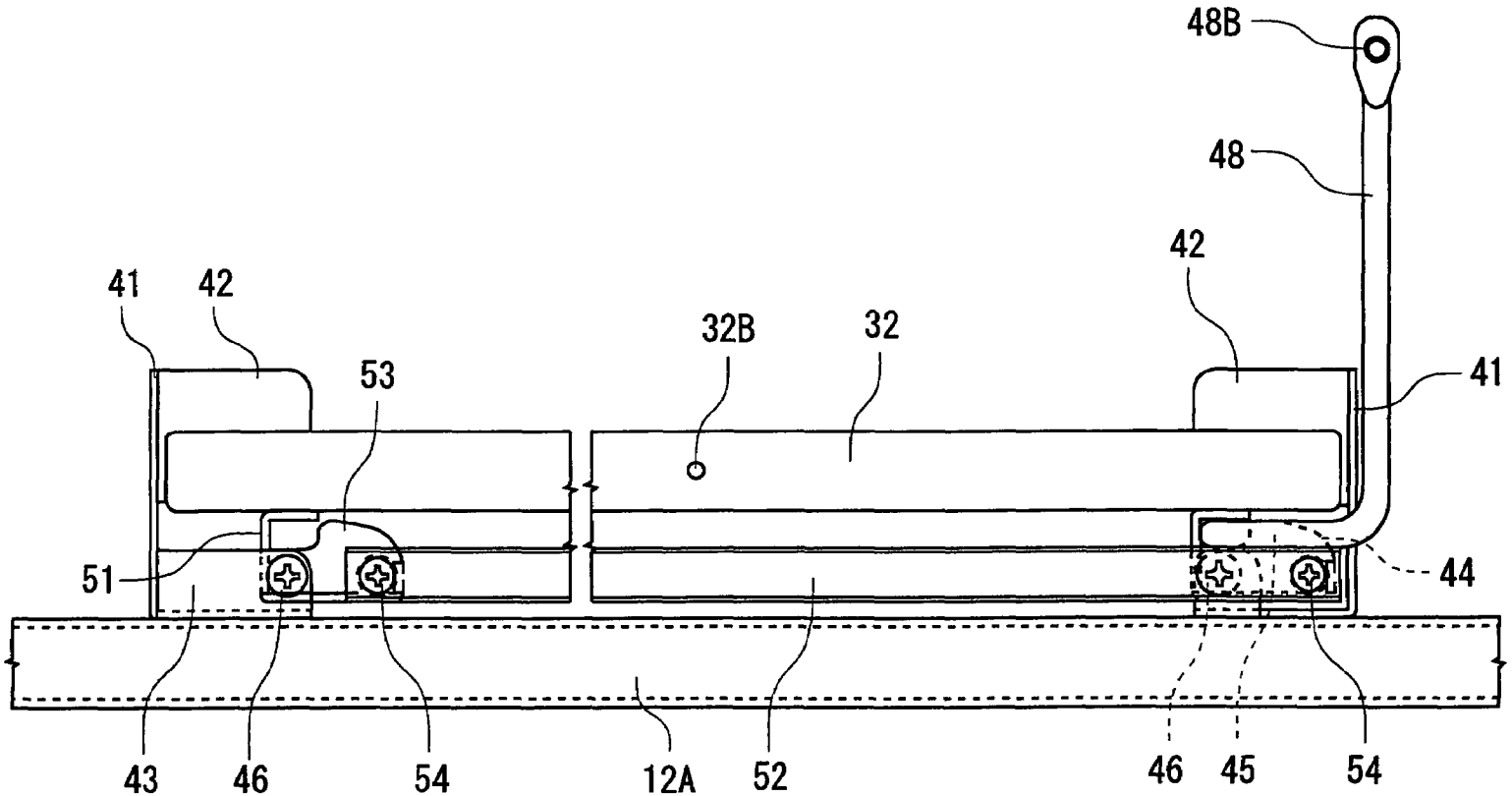
FIG. 14 is a partly enlarged front view of the pushing-up member in fallen down state (embodiment 2)
Figure 15:
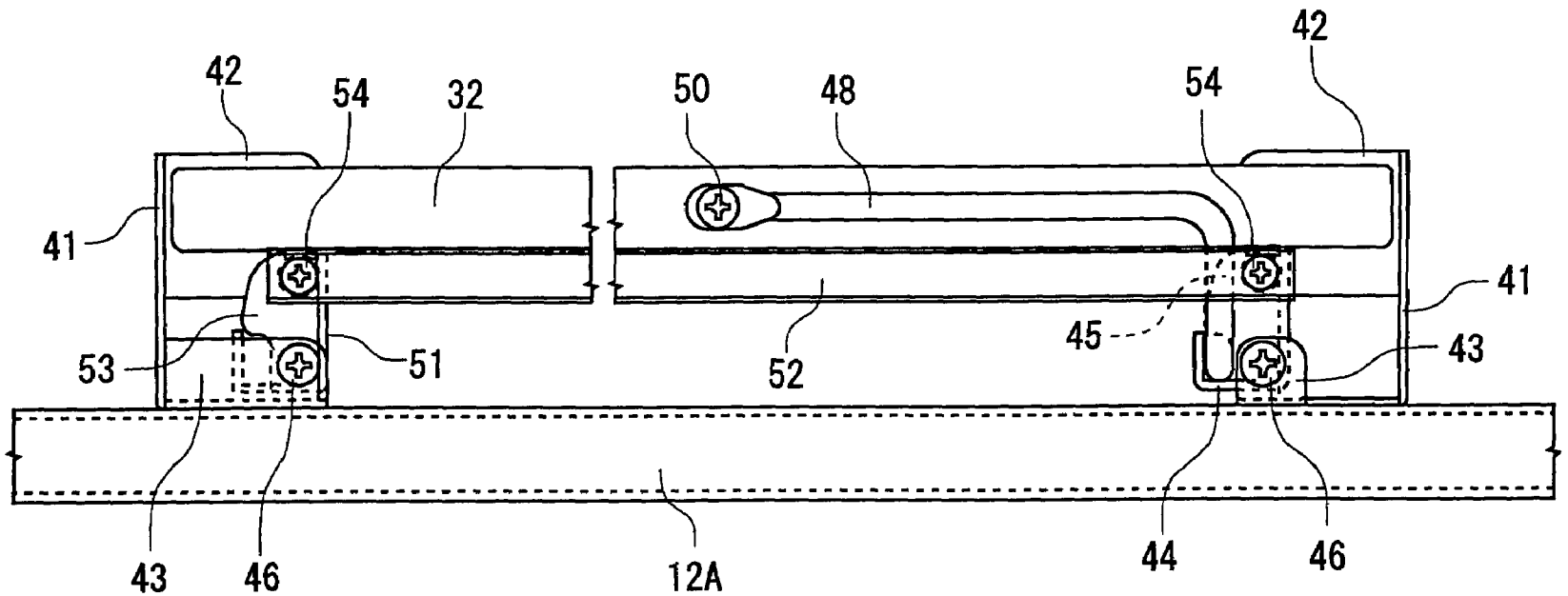
FIG. 15 is a partly enlarged front view of the pushing-up member upright standing state (embodiment 2)
Figure 16:
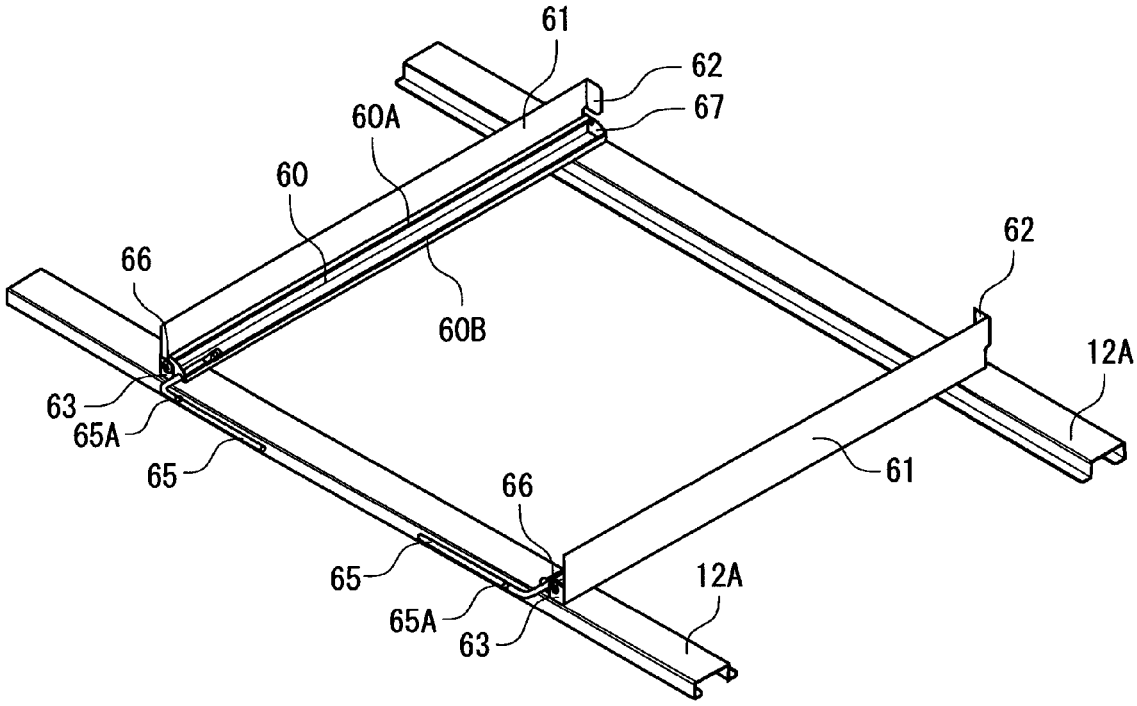
FIG. 16 is a perspective view of the pushing-up mechanism (embodiment 3)
Figure 17:
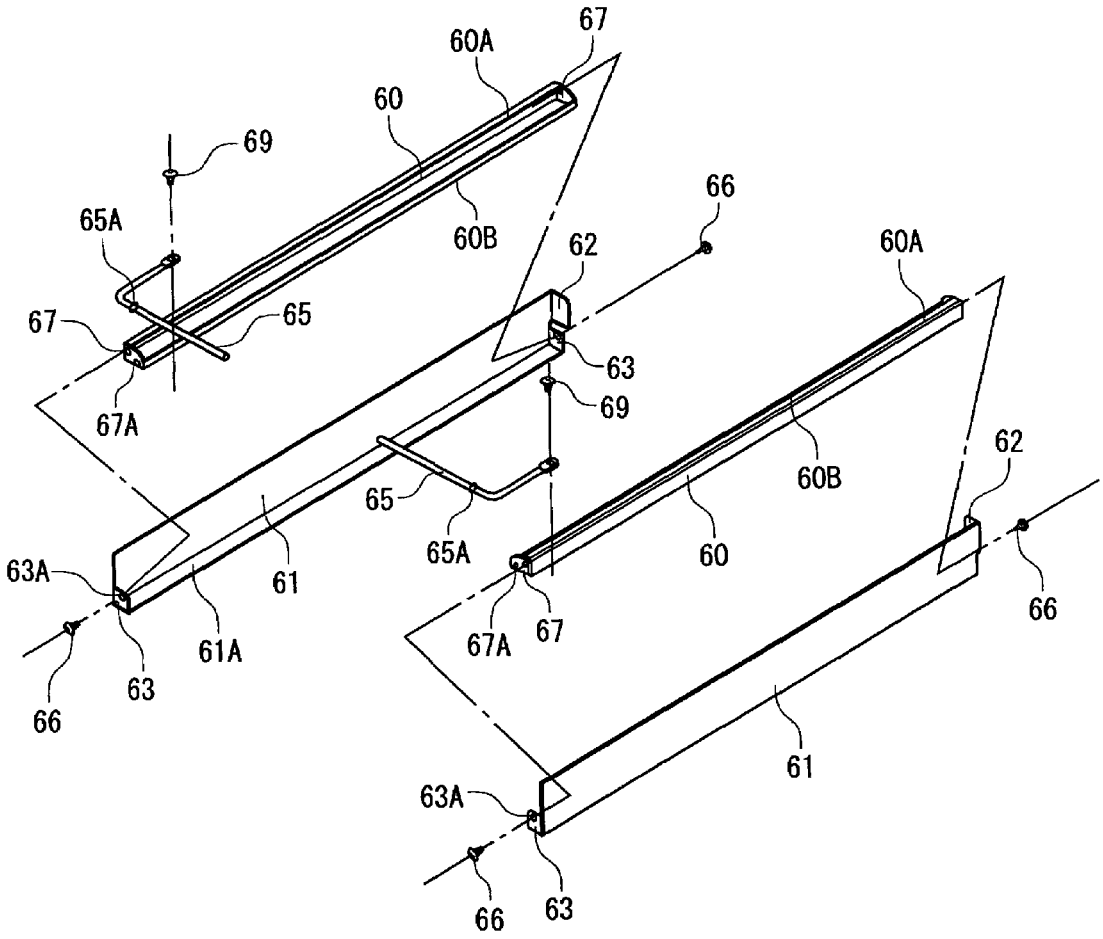
FIG. 17 is an exploded perspective view of the pushing-up mechanism (embodiment 3)

As a pushing-up mechanism like that described above, there is one shown in FIGS. 14 and 15 as the second embodiment other than the mechanism described above. In this embodiment, both the pushing-up members 44 in the embodiment descried above are fixed to fixing members 41, 41 in a manner pivotally movable about pivot shafts 46 in the same direction. In other words, according to the pushing-up mechanism in this case, the pushing-up member 44 on one side is constructed in the same manner as in the embodiment described above, while the pushing-up member 51 on the other side is pivotally mounted onto a flange 43 of the fixing member 41 by means of the pivot shafts 46 in the same direction as the pushing-up member 44 on the one side. In this manner, the pivoting direction of the pushing-up member 51 is the same as that of the pushing-up member 44. In this case, the pushing-up member 51 is constructed similarly to the pushing-up member 44.

Moreover, a connecting member (link means) 52 is secured to the cam surfaces 45 and 53 of the pushing-up members 44 and 51 for connecting the pushing-up members 44 and 51 by means of screws 54, 54. The operating arm 48 is provided only on one pushing-up member 44 or 51 (the pushing-up member 44 in the illustrated embodiment).

In this manner, the pushing-up members 44, 51 can be interlocked with each other. Accordingly, in the case that the mounting base 32 for the cooling unit R is pushed up similarly to that in the embodiment described above, the operating arm 48 is pressed downwardly to cause the arm to fall down from the state of standing upright so that the pushing-up members 44 and 51 can be simultaneously pivotally moved about respective pivot shafts 46 through the connecting member secured to the pushing-up members 44 and 51. In this manner, the mounting base 32 is pushed up by the variation in radius of the cam surfaces 45 and 53 of the pushing-up members 44 and 51 from the pivot shafts 46. For this reason, the cooling box 22 fixed to the mounting base 32 is also pushed up so that the openings of the upper surface of the cooling box 22 can abut against the lower surface of the bottom wall 2A of the thermal insulating housing 2.

At this time, as the pushing-up members 44, 51 are connected by the connecting member 52, merely by the operation of the operating arm 48 provided only on one side, the pushing-up members 44 and 51 are simultaneously pivotally moved to enable both the sides of the mounting base 32 for the cooling unit R to be pushed up. In this manner, the mounting operation can be more simplified than the first mentioned embodiment.

In the present embodiment, also the operating arm 48 is caused to fall down from the upright standing state, and then the operating arm 48 is fixed to the mounting base 32 by means of a screw 50 passing through the fixing hole 48B formed in the operating arm 48 and the fixing hole 32B formed in the forward end of the mounting base 32 and aligned with the fixing hole 48B of the operating arm 48. According to this construction, it is possible to avoid the operating arm 48 from naturally moving from its fallen down state to its upright standing state due to the own weight of the cooling unit R so that the cooling unit R can be stably fixed.

Embodiment 3

A cold storage comprising a pushing-up mechanism according to the third embodiment of the invention will then be explained with reference to FIGS. 16 to 22. At this moment, as the pushing-up mechanism in the present embodiment is applicable to the cold storage 1 in the first embodiment, the cold storage 1 will not be described further.

Similarly to that is the first embodiment, the pushing-up mechanism in the third embodiment pushes up the cooling unit R together with the mounting base 32 toward the bottom wall 2A, and comprises a pair of fixing member 61, 61, a pair of pushing-up members 60, 60, and operating arms 65, 65 for pivotally moving the pushing-up members 60. Moreover, pushing-up means comprises the pushing-up members 60 and the operating arms 65.

The fixing members 61, 61 extend on both the sides of the cooling unit R from front to rear when the cooling unit R is in the machine room, that is, from the front side to the rear side of the machine room 21 and have a substantially L-shaped cross-section opening toward the interior of the machine room 21. The fixing members 61 are each formed with engaging apertures (not shown) at front and rear ends of the bottom surface 61A. The fixing members 61 are fixed to the base leg angles 12 by tightening these members as by set screws passing through the engaging apertures and engaging apertures (not shown) which are previously formed in the lower members 12A of the base leg angles 12 at front and rear sides and brought into alignment with the engaging apertures of the fixing members.

Moreover, similarly to the first embodiment, the fixing members 61 are each formed at a rear end of the side surface with a stopper (positioning means) 62 which is bent substantially at right angles and extending toward the interior of the machine room 21. Further, the fixing members 61 are each formed at the front and rear ends of the bottom surface with flanges 63 which are bent upward substantially at right angles. The flanges 63 are each formed with an engaging hole 63A for receiving a pivot shaft 66 for pivotally mounting the front or rear end of the pushing-up member 60.

The pushing-up members 60 are constructed from the forward ends to the rear ends of the fixing members 61 or from the front side to the rear side of the machine room 21 and are mounted on the flanges inside the fixing members 61 so as to be pivotally movable about the pivot shafts 66. When the pushing-up members 60 are in fallen down state or in substantially horizontal position, the pushing-up members 60 have a substantially L-shaped cross-section opening toward the interior of the machine room 21. In such a state, the pushing-up members 60 are formed at upper ends and side ends with horizontal surfaces 60A and 60B inwardly bent at right angles, respectively. In the fallen down state, the pushing-up members 60 are formed at the forward and rear ends with cam surfaces 67 upwardly bent substantially at right angles. The cam surfaces 67 are each formed at an inner corner with an engaging hole 67A for pivotally mounting the pushing-up member on the pivot shaft 66 passing through the engaging hole 67A and the engaging hole 63A of the flange 63.

Figure 20:
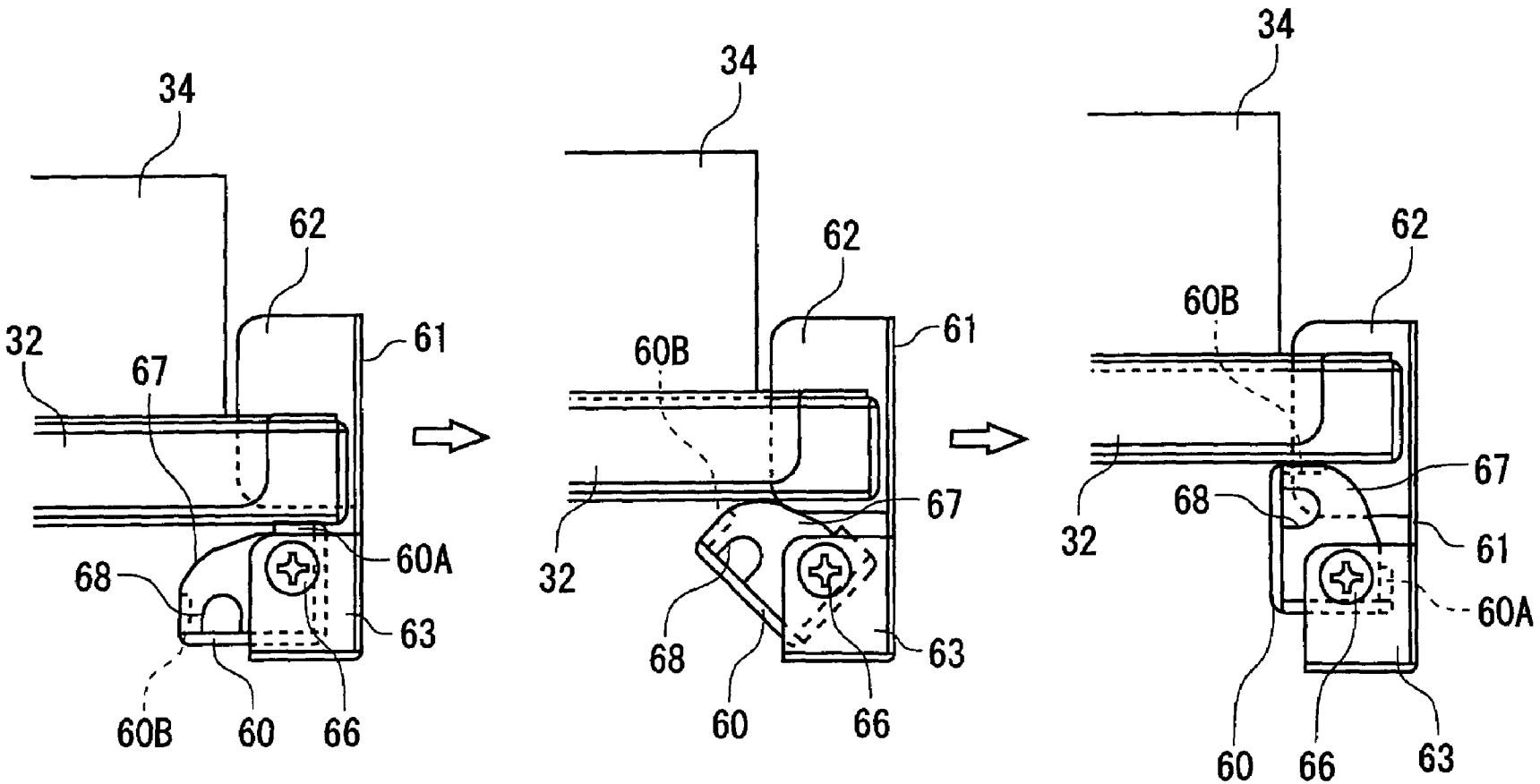
FIG. 20 is a view illustrating pivoting states of the pushing-up member (embodiment 3)

The horizontal surfaces 60A abut against the lower surface of the mounting base 32 at its both sides in the state that the cooling unit R is accommodated in the machine room 21. The cam surfaces 67 are each formed in a manner that its radius from the pivot shaft 66 becomes progressively larger on proceeding of the pivotal movement of the pushing-up member 60 about the pivot shaft 66 toward the side surface of the fixing members 61. Consequently, starting from the state that the mounting base 32 is arranged on the horizontal surfaces 60A which are the uppermost surfaces of the pushing-up members 60 in the fallen down state as shown at the left of FIG. 20, the pushing-up members 60 are pivotally moved about the pivot shafts 66 toward the side surface of the fixing members 61 (shown at the center of FIG. 20) and further to the upright standing state (shown at the right of FIG. 20). The abutting surfaces of the cam surfaces 67 against the mounting base 32 are changed from the horizontal surfaces 60A to edges of the cam surfaces 67 and further to the horizontal surfaces 60B so that the mounting base 32 arranged on the pushing-up members 60 is pushed up by the increase of the radius of the cam surfaces 67.

Moreover, there are no cam surfaces between the cam surfaces 67 at the forward and rear ends of the pushing-up members 60. However, by providing the horizontal surfaces 60A and 60B, the mounting base 32 can be held in a stable condition, in the state that the pushing-up members 60 are fallen down or stand upright. In other words, in the state that the pushing-up members 60 are fallen down, the lower surface of the mounting base 32 can be stably held by the horizontal surfaces 60A, and during the pivotal movement of the pushing-up members about the pivot shafts 66, the lower surface of the mounting base 32 is also stably held by the edges of the cam surfaces 67. Further, in the state that the pushing-up members 60 stand upright, the lower surface of the mounting base 32 is also stably held by the horizontal surfaces 60B under the condition the mounting base 32 is pushed up.

Moreover, the cam surfaces 67 of the pushing-up members 60 are each formed with an inserting hole 68 between the horizontal surface 60A and the edge of the cam surface. The operating arm 65 is inserted into the inserting hole 68, and the end of the operating arm 65 positioned inwardly of the pushing-up member 60 is fixed to the pushing-up member 60 by means of a screw 69 so that the operating arm 65 is mounted in position.

The operating arm 65 is a bar-shaped member made of a metallic material and extends from the end being attached in the fixing member 61 to the forward end of the pushing-up member 60 and then in front of the pushing-up member 60 is bent substantially at right angles toward the interior of the machine room 21. The operating arm 65 is also formed with a fixing hole 65A for fixing the operating arm 65 to the forward end of the mounting base 32. The position of the fixing hole 65A in the operating arm 65 corresponds to the forward end of the pushed up mounting base 32 when the operating arm 65 stands upright.

Figure 18:
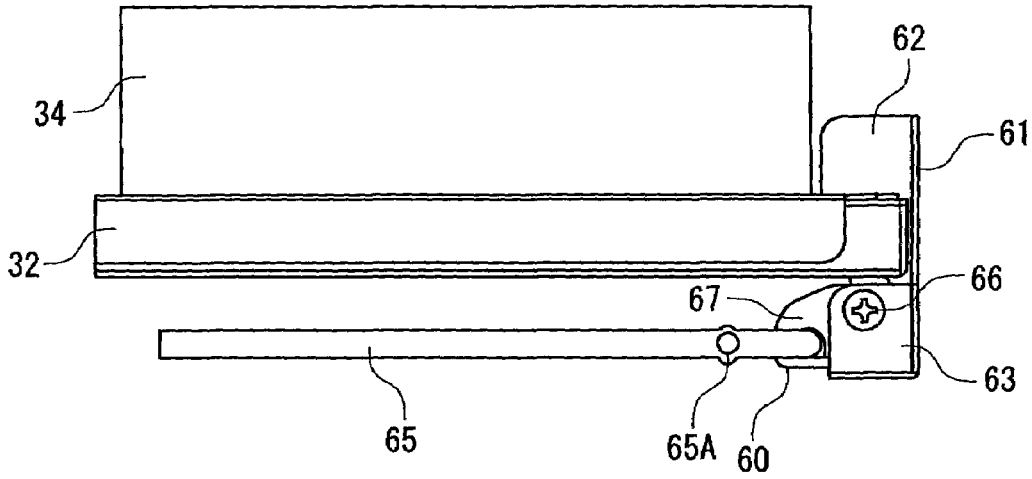
FIG. 18 is a partly enlarged front view of the pushing-up member of the pushing-up mechanism in fallen down state (embodiment 3)
Figure 19:
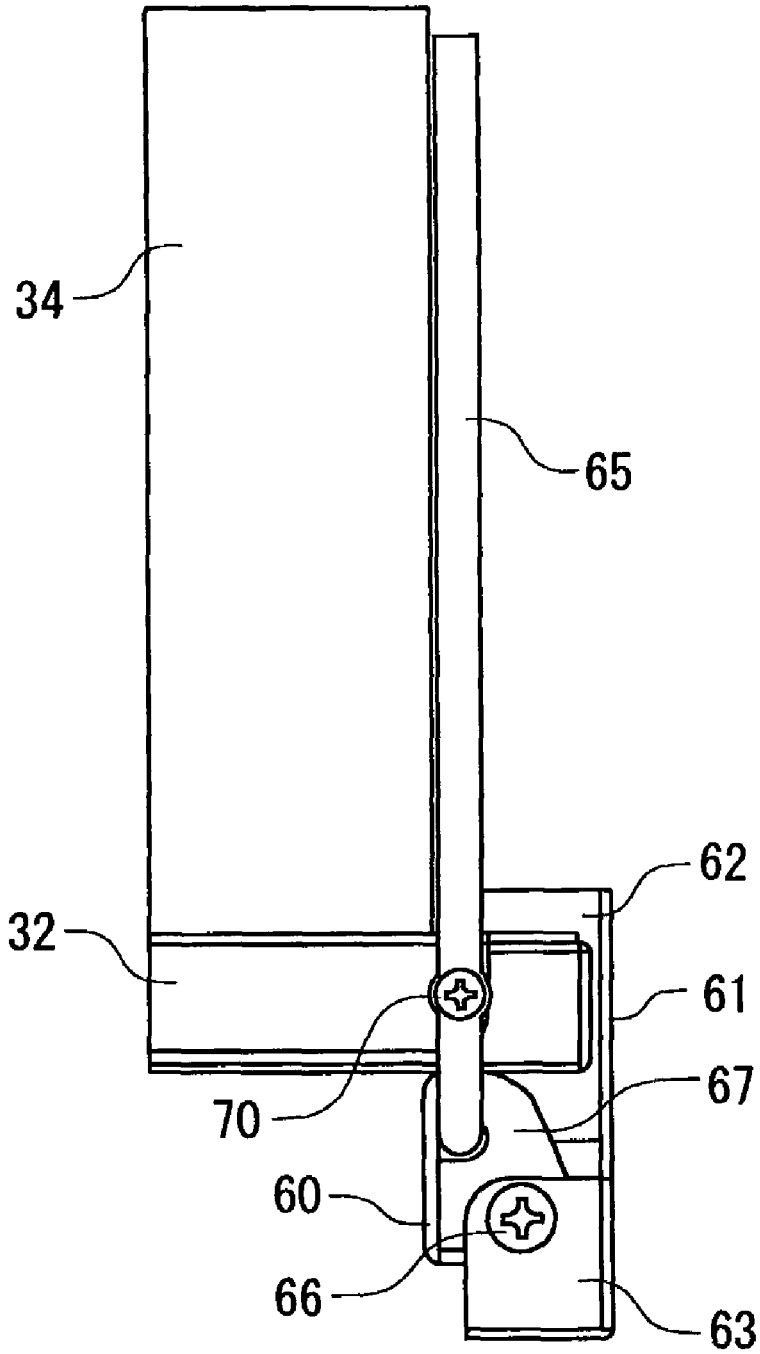
FIG. 19 is a partly enlarged front view of the pushing-up member in upright standing state (embodiment 3)

According to such a construction, in the state that the pushing-up members 60 are fallen down, the forward ends of the operating arms 65 also come into the fallen down state. Consequently, when the mounting base 32 for the cooling unit R is inserted, the problem of interruption by the operating arms 65 can be eliminated as shown in FIG. 18, thereby improving the operationality. In a certain construction, it becomes possible to reduce the spacing between the pushing-up members 60, 60 on both sides and hence to realize a miniaturization of the pushing-up means.

Figure 21:
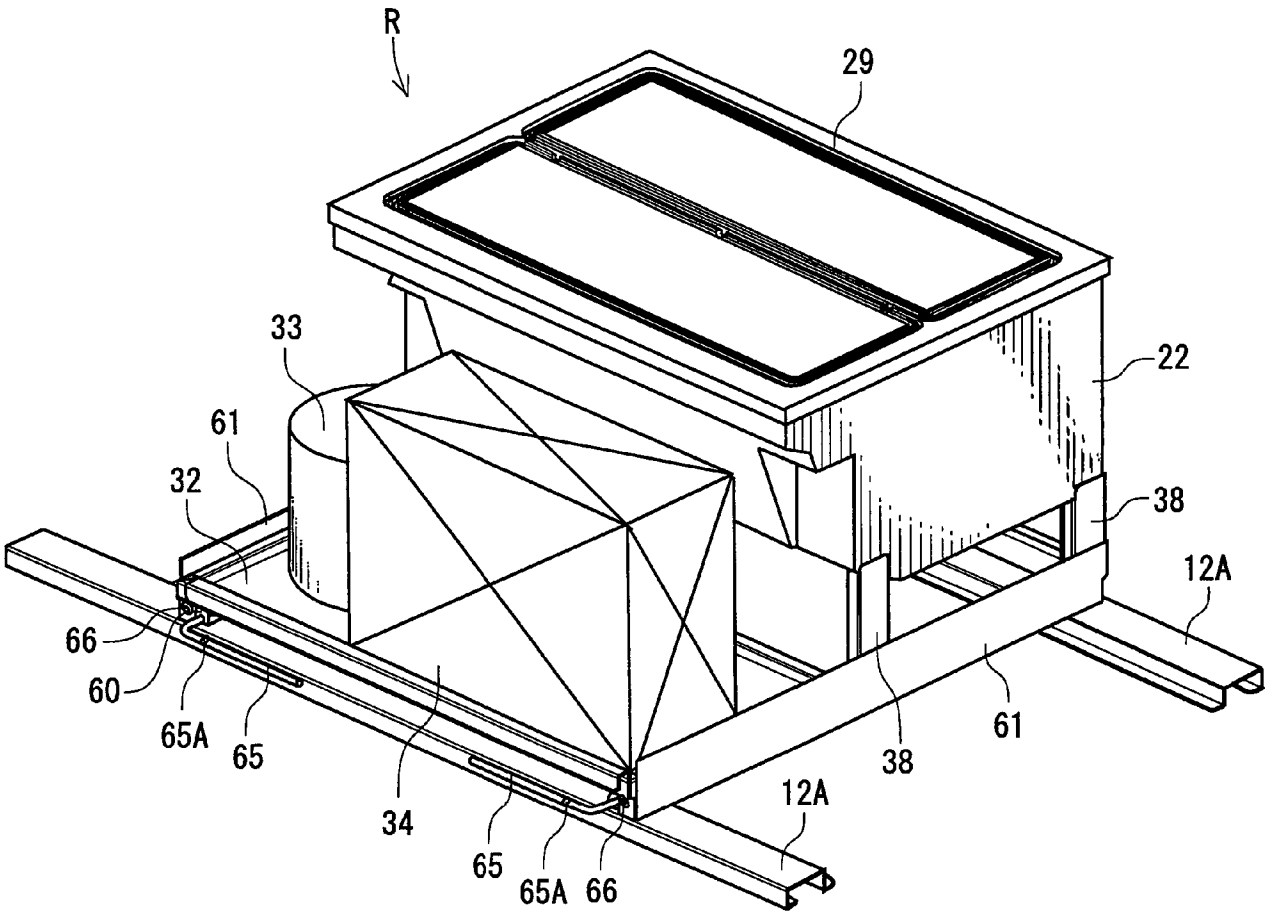
FIG. 21 is a perspective view of the cooling unit inserted onto the pushing-up mechanism (before being pushed up) (embodiment 3)
Figure 22:
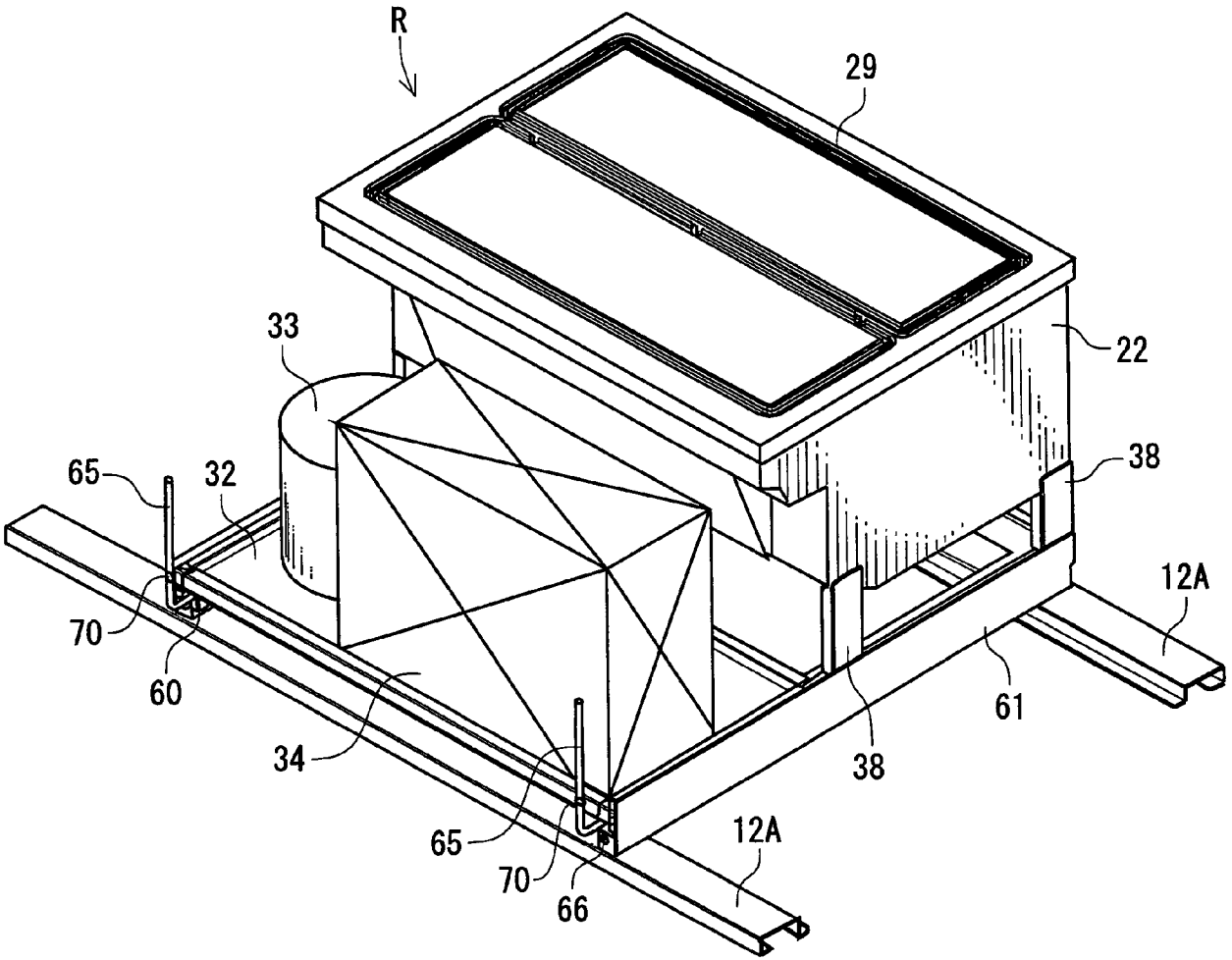
FIG. 22 is a perspective view of the cooling unit pushed up by the pushing-up mechanism (embodiment 3)
Figure 23:
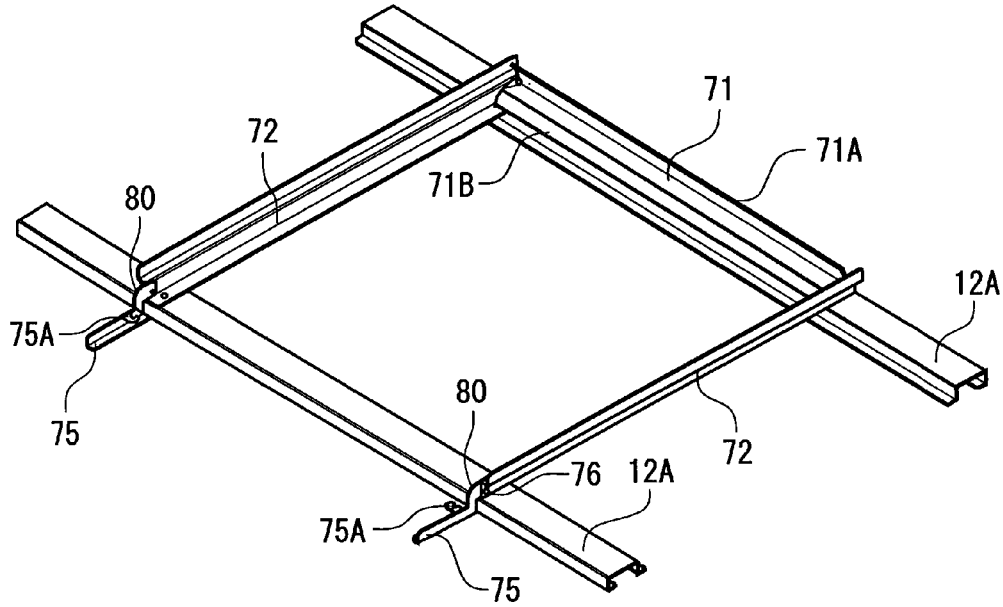
FIG. 23 is a perspective view of the pushing-up mechanism (embodiment 4)
Figure 24:
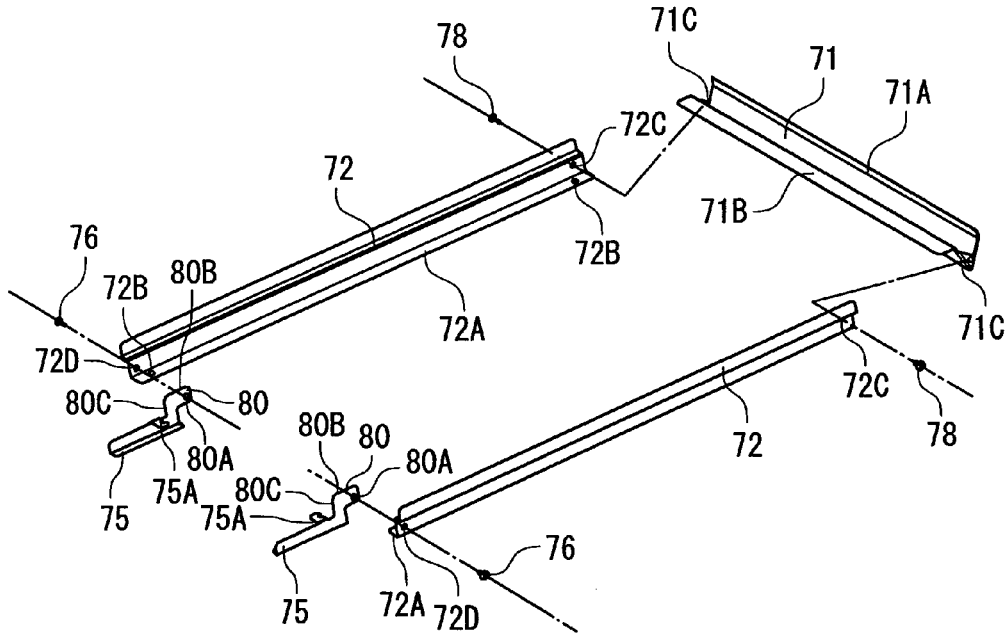
FIG. 24 is an exploded perspective view of the pushing-up mechanism (embodiment 4)

According to the construction as discussed above, the mounting base 32 for the cooling unit R as described above is admitted into the machine room 21 from its front side. At this time, the mounting base 32 is positioned with respect to the lateral direction by the side faces of both the fixing members 61, 61 fixed to the lower members 12A of the base leg angles 12 at front and rear sides. The side ends of the lower surface of the mounting base 32 at both the sides are caused to abut against the upper surfaces of the horizontal surfaces 60A of the pushing-up members 60 mounted inwardly of the fixing members 61, and the mounting base 32 is slidably moved inwardly until it abuts against stoppers 62 formed at the rear ends of the fixing members 61 so that the mounting base 32 is inserted in the machine room 21 as shown in FIG. 21.

In this manner, the cold air suction port 27 and the cold air discharge port 28 formed in the cooling box 22 of the cooling unit R can be accurately positioned correspondingly to the lower ends of the cooling air suction port 14 and the cooling air discharge port 15 formed in the bottom wall 2A of the thermal insulating housing 2. Thus, the mounting operation is simplified, and leakage of the cold air due to shifting of the mounting base 32 back and forth after being fixed can be restrained.

Moreover, under the condition that the cold air suction port 27 and the cold air discharge port 28 of the cooling box 22 are below the cold air suction port 14 and the cold air discharge port 15 of the bottom wall 2A of the thermal insulating housing 2, the operating arms 65 mounted on both the sides as described above are operated so as to stand upright so that the pushing-up members 60 to which the operating arms 65 are fixed are pivotally moved about the pivot shafts 66 as discussed above. As a result, the mounting base 32 is pushed up by the variation in radius of the cam surfaces 67 of the pushing-up members 60 from the pivot shafts 66. Therefore, the cooling box 22 fixed to the mounting base 32 is also pushed up so that the openings of the upper surface of the cooling box 22 can be brought into abutment against the lower surface of the bottom wall 2A of the thermal insulating housing 2. At this time, as the seal members 29 have been attached to the margins of the openings of the cooling box 22 as described above, the openings of the upper surface of the cooling box 22 can be hermetically pushed to the bottom wall 2A with the expansion and contraction of the seal members 29.

Therefore, the cooling unit R composed of an integrated combination of the compressor 33, the condenser 34, cooling box 22 and the like can be secured to the bottom wall 2A of the thermal insulating housing 2 without any objection so that the cold air which has been heat-exchanged with the cooler 24 is delivered by the blower 25 for the cooler from the cold air discharge port 15 into the storage room 6 and further drawn from the cold air suction port 14 into the cooling chamber 23, thereby forming an cold air circulation enabling the interior of the storage room 6 to be cooled. Particularly, the ends of the lower surface of the mounting base 32 for the cooling unit R are loaded on the pushing-up members 60, and the operating arms 65 are caused to stand upright from their fallen down state so that the mounting base 32 can be fixed in the pushed up condition, thereby facilitating the mounting operation of the cooling unit R.

In the relevant arrangement, moreover, the pushing-up members 60 are brought into abutment against the lower surface of the mounting base 32 of the cooling unit R, and the operating arms 65 are actuated to push up the cooling unit R, thereby achieving a reduction in cost because of no need for particularly constituting a pushing-up structure on the side of the cooling unit R. Further, by mounting the fixing members 61 and the pushing-up members 60 onto the angles 12 of the machine room 21, the pushing-up mechanism can be constructed so that various cooling units R may be accommodated and hence the versatility can be enhanced.

Furthermore, according to the relevant embodiment of the invention also, as the stoppers 62 are provided at the rear ends of the fixing members 61 as positioning means, mounting position can be defined when the cooling unit R is inserted into the machine room 21, thereby facilitating the mounting operation. By causing the operating arms 65 to stand upright, the cooling unit R is forced into the pushed up state, and at this moment, the operating arms 65 are positioned forwardly of the mounting base 32 so that the forward movement of the cooling unit R can be impeded by the operating arms 65. Therefore, the cooling unit R can be easily positioned, thereby achieving simplification of the mounting operation. Moreover, the forward and rearward movement of the cooling unit R in the fixed state can be securely restricted so that the cooling unit R can be stably fixed.

Moreover, the operating arms 65 in their standing upright state are positioned at the forward end of the mounting base 32 which is pushed up, and the operating arms 65 are fixed to the mounting base 32 by means of the screws 70 passing through the fixing holes 65A formed in the operating arms 65 and the fixing holes 32B previously formed in the forward end of the mounting base 32 and brought into alignment with the fixing holes 65A of the operating arms, thereby avoiding problematical lowering of the mounting base 32 due to the own weight of the cooling unit R.

In the present embodiment, moreover, the operating arms 65 may be provided with a handle portion similarly to in the first embodiment.

Embodiment 4

A cold storage comprising a pushing-up mechanism according to the fourth embodiment of the invention will then be explained with reference to FIGS. 23 to 29. At this moment, as the pushing-up mechanism in the present embodiment is applicable to the cold storage 1 in the first embodiment, the cold storage 1 will not be described further.

Similarly to that in the first embodiment, the pushing-up mechanism according to the fourth embodiment pushes up the cooling unit R together with the mounting base 32 toward the bottom wall 2A, and comprises a pair of fixing members 72, 72, a rear pushing-up member 71 constructed over the rear ends of the fixing members 72, 72, and a pair of front pushing-up members 75, 75 pivotally attached to the forward ends of the fixing members 72, 72 by means of pivot shafts 76.

The fixing members 72, 72 extend on both the sides of the cooling unit R from front to rear when the cooling unit R is in the machine room, that is, from the front side to the rear side of the machine room 21 and have a substantially L-shaped cross-section opening toward the interior of the machine room 21. Upper ends of the fixing members are further bent to have a substantially L-shaped cross-section opening toward the interior of the machine room 21. The fixing members 72 are each formed with engaging apertures 72B, 72B at front and rear ends of the bottom surface 72A. The fixing members 72 are fixed to the base leg angles 12 by tightening these members as by set screws passing through the engaging apertures 72B and engaging apertures (not shown) which are previously formed in the lower members 12A of the base leg angles 12 at front and rear sides and brought into alignment with the engaging apertures 72B.

Figure 25:
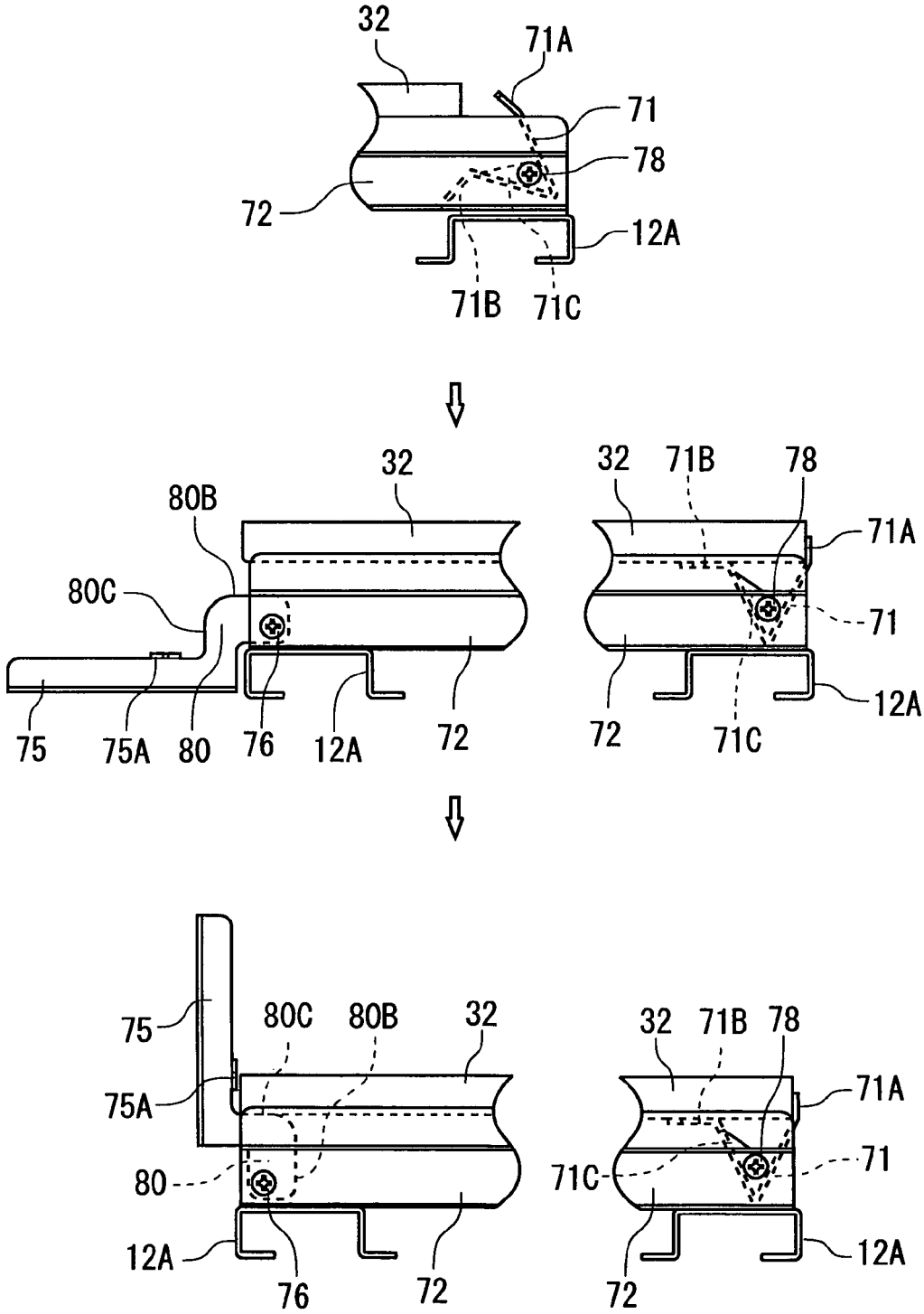
FIG. 25 is a view illustrating pivoting states of the rear and front pushing-up members (embodiment 4)

Then, the rear pushing-up member 71 is attached to the ends of the fixing members 72, 72 to extend therebetween. As shown in FIG. 25, the rear pushing-up member 71 has a substantially V-shaped cross-section and is formed at the rear edge with a stopper (positioning means) 71A which is formed by slightly bending the rear edge toward the interior of the machine room 21. On the other hand, the rear pushing-up member 71 is formed at the front edge with a holding surface 71B which is bent to be horizontal relative to the stopper 71A. Further, the rear pushing-up member 71 is formed at its both ends with flanges 71C which are each formed with an engaging hole 71D for pivotally mounting the rear pushing-up member 71 by means of pivot shafts 78 passing through the engaging holes 71D and the engaging holes 72C formed in the fixing members 72 and brought into alignment with the engaging holes 71D.

According to this construction, the rear pushing-up member 71 is usually in a state that it has been pivotally moved forwardly by its own weight. When the mounting base 32 is inserted from the front side, the rear end of the mounting base 32 rides up on the upper edge of the holding surface 71B and the mounting base 32 is further slidably moved rearwards so that the stopper 71A is pushed rearward, thereby holding the rear end of the mounting base 32 by the stopper 71A and positioning the rear end of the mounting base 32. At this time, moreover, the rear pushing-up member 71 is caused to be pivotally moved rearward about the pivot shafts 78 so that the mounting base 32 is held by the holding surface 71B in the state that the rear edge of the lower surface of the mounting base 32 is pushed upward.

On the other hand, front pushing-up members 75, 75 are attached to the forward ends of the fixing members 72, 72. The front pushing-up members 75 each have a substantially L-shaped cross-section opening toward the interior of the machine room 21, and a rear end of the side surface which slightly extends upright and is formed with a cam surface 80 extending rearward. The cam surface 80 is formed at a rear corner with an engaging hole 80A for pivotally mounting the front pushing-up member 75 onto the fixing member 72 by means of a pivot shaft 76 passing through the engaging hole 80A and a engaging hole 72D formed in the forward end of the fixing member 72 and aligned with the engaging hole 80A.

The cam surfaces 80 are adapted to abut against the lower surface of the mounting base 32 at both the sides under the condition that the cooling unit R has been received in the machine room 21. The cam surface 80 is formed in a manner that its radius from the pivot shaft 76 becomes progressively larger on proceeding of the pivotal movement of the front pushing-up member 75 about the pivot shaft 76 toward the interior of the machine room 21. Consequently, starting from the state that the mounting base 32 is arranged on the upper surfaces 80B which are facing upwardly as shown at the center of FIG. 25, the front pushing-up members 75 are pivotally moved about the pivot shafts 76 rearward into the upright standing state (shown at the lower portion in FIG. 25). In this manner, the surfaces abutting against the mounting base 32 are changed from the upper surfaces 80B to the edges of the cam surfaces 80 and further to front surfaces 80C so that the forward portion of the mounting base 32 arranged on the front pushing-up members 75 is pushed up by the increase of the radius of the cam surfaces 80.

The front pushing-up members 75 are each formed forwardly of the cam surface 80 with a latching portion 75A extending toward the interior of the machine room 21. Therefore, when the front pushing-up members 75 are in upright standing state, the latching portions 75A are able to engage the front edge of the mounting base 32. In this manner, the state of the front push-up members 75 standing upright can be held by the latching portions 75A, thereby avoiding problematical lowering of the front pushing-up members 75 due to the own weight of the cooling unit R.

Figure 26:
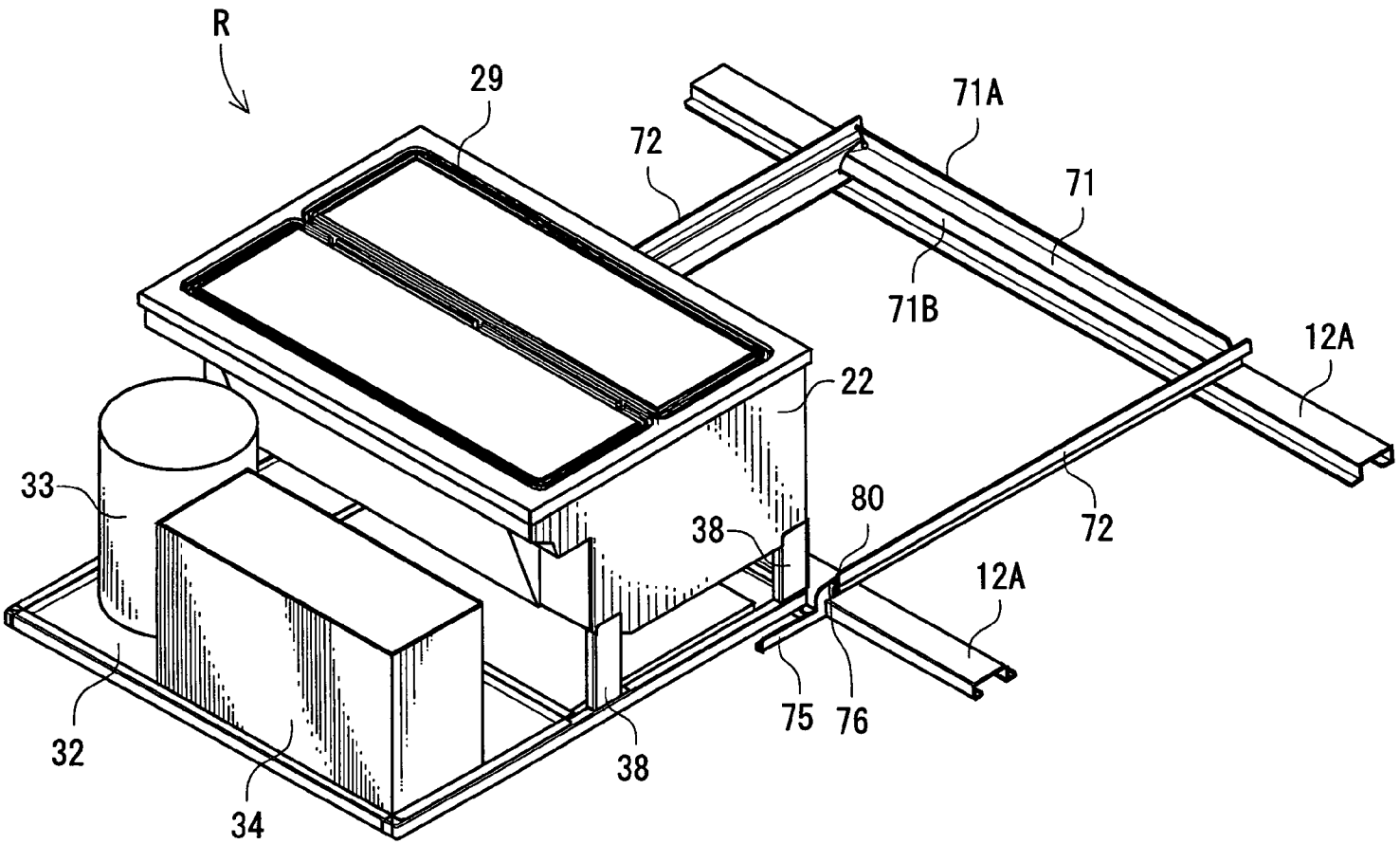
FIG. 26 is a perspective view of the cooling unit before inserting onto the pushing-up mechanism (embodiment 4)
Figure 27:
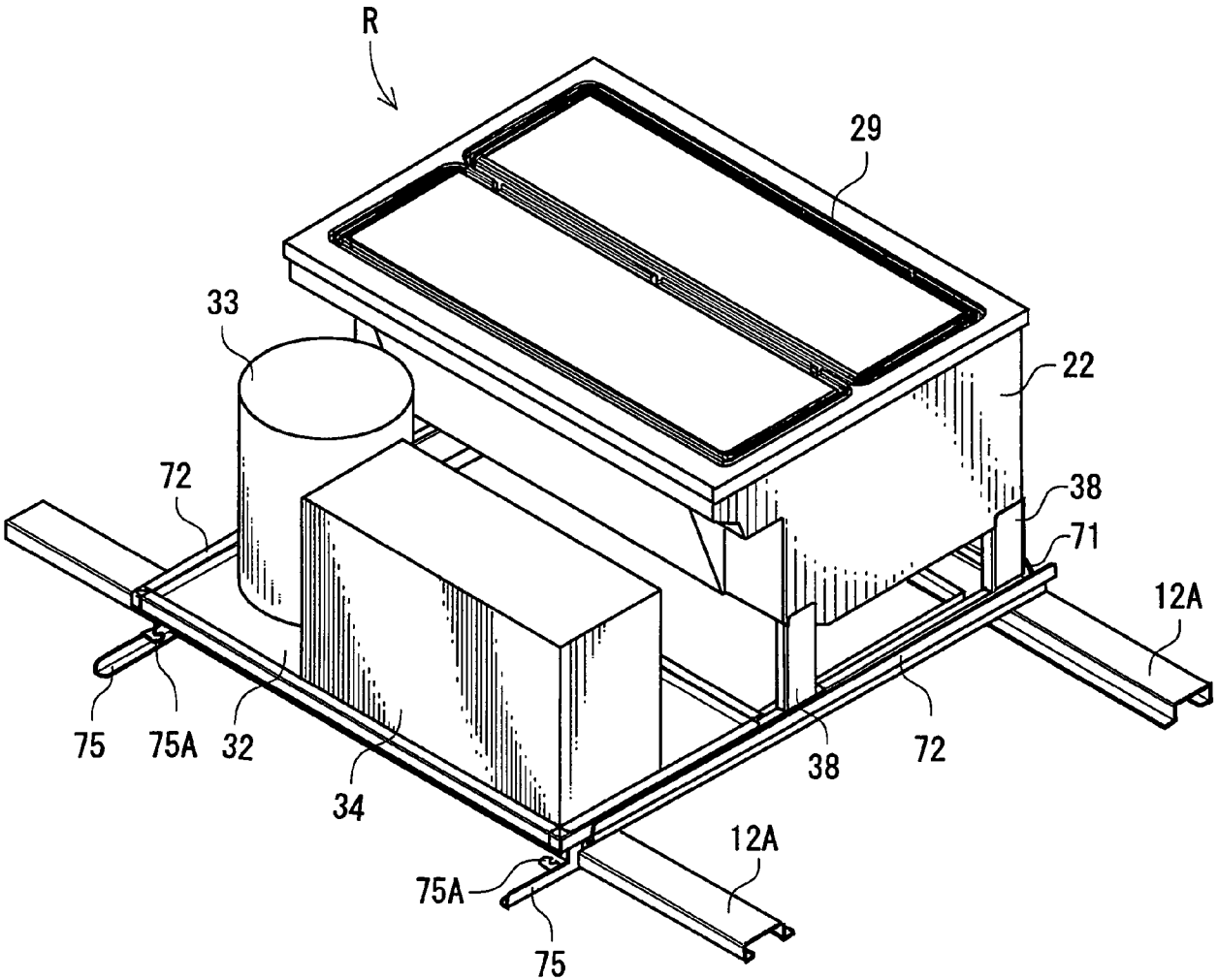
FIG. 27 is a perspective view of the mounting base of the cooling unit before inserting onto the rear pushing-up member (embodiment 4)
Figure 28:
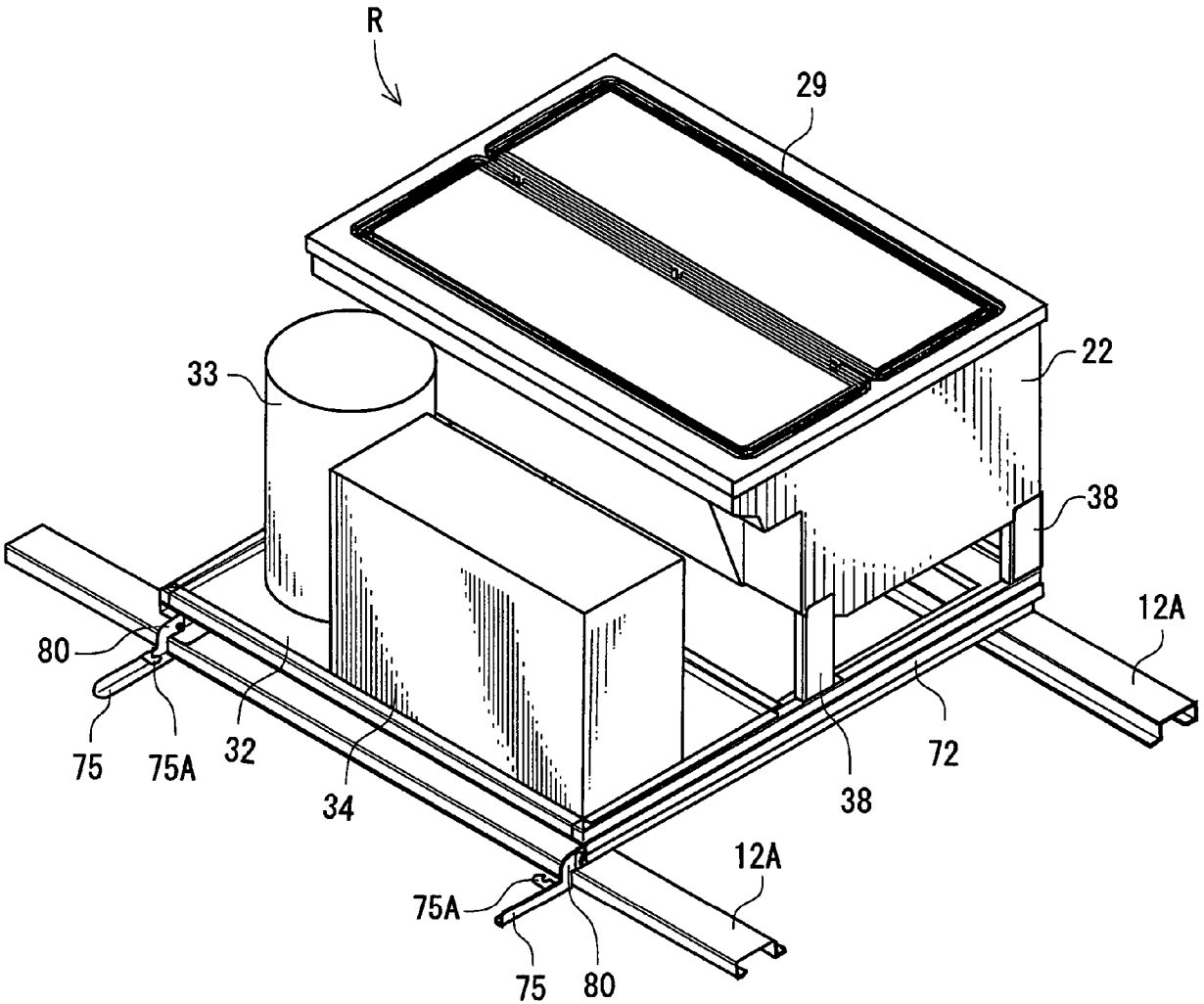
FIG. 28 is a perspective view of the cooling unit pushed up by the rear pushing-up member (embodiment 4)

According to the above construction, the mounting base 32 for the cooling unit R as described above is admitted into the machine room 21 from its front side. At this time, the mounting base 32 is positioned with respect to the lateral direction by the side faces of both the fixing members 72, 72 fixed to the front and rear ends of the lower members 12A of the base leg angles 12 (FIG. 26). Further, the mounting base 32 is brought into abutment against the holding surface 71B of the rear pushing-up member 71 provided at the rear ends of the fixing members 72 as described above, and further the mounting base 32 is caused to be slid rearward so that the rear pushing-up member 71 is pivotally moved rearward, thereby holding the rear edge of the lower surface of the mounting base 32 on the upper surface of the holding surface 71B. In this manner, the lower surface of the rear portion of the mounting base 32 is pushed up toward the bottom wall 2A of the thermal insulating housing 2 (FIG. 27). And further the mounting base 32 is caused to be slid rearward so that the mounting base 32 is positioned with its rear end by the stopper 71A of the rear pushing-up member 71 (FIG. 28).

In this manner, the cold air suction port 27 and the cold air discharge port 28 formed in the cooling box 22 of the cooling unit R can be accurately positioned correspondingly to the lower ends of the cooling air suction port 14 and the cooling air discharge port 15 formed in the bottom wall 2A of the thermal insulating housing 2. Thus, the mounting operation is simplified, and leakage of the cold air due to shifting of the mounting base 32 back and forth after being fixed can be restrained.

At this time, the cold air suction port 27 and the cold air discharge port 28 of the cooling box 22 are positioned under the cold air suction port 14 and the cold air discharge port 15 of the bottom wall 2A of the thermal insulating housing 2, and the rear pushing-up member 71 is caused to be pivotally moved about the pivot shafts 78 rearward so that the rear portion of the mounting base 32 is pushed up by the movement of the holding surface 71B of the rear pushing-up member 71.

Figure 29:
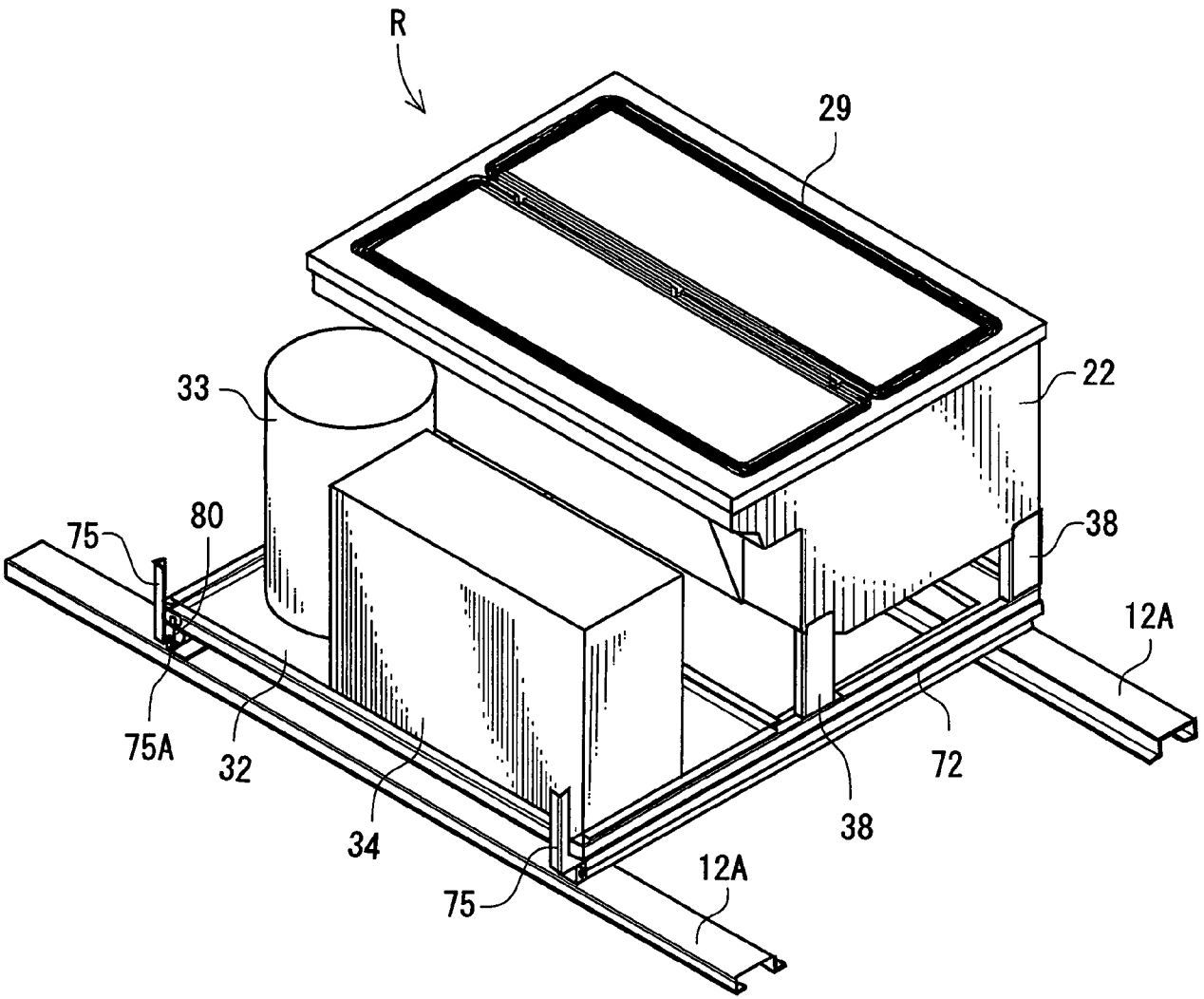
FIG. 29 is a perspective view of the cooling unit pushed up by the pushing-up mechanism (embodiment 4).

Thereafter, as shown in FIG. 29 both the front pushing-up members 75, 75 attached to the forward ends of the fixing members 72 are caused to be pivotally moved about the pivot shafts 76 rearward so that the forward portion of the mounting base 32 is pushed up by the increase in radius caused by the pivotal movement of the cam surfaces 80 of the front pushing-up members 75.

Therefore, the whole mounting base 32 is pushed up or the cooling box 22 fixed to the mounting base 32 is also pushed up so that the openings of the upper surface of the cooling box 22 can be brought into abutment against the lower surface of the bottom wall 2A of the thermal insulating housing 2. At this time, as the seal members 29 have been attached to the margins of the openings of the cooling box 22 as described above, the openings of the upper surface of the cooling box 22 can be hermetically pushed to the bottom wall 2A with the expansion and contraction of the seal members 29.

Accordingly, the cooling unit R composed of an integrated combination of the compressor 33, the condenser 34, cooling box 22 and the like can be secured to the bottom wall 2A of the thermal insulating housing 2 without any objection so that the cold air which has been heat-exchanged with the cooler 24 is delivered by the blower 25 for the cooler from the cold air discharge port 15 into the storage room 6 and further drawn from the cold air suction port 14 into the cooling chamber 23, thereby forming an cold air circulation enabling the interior of the storage room 6 to be cooled. Particularly, the ends of the lower surface of the mounting base 32 for the cooling unit R are loaded on the rear pushing-up members 71, and further the front pushing-up members 75, 75 are caused to stand upright from their fallen down state so that the mounting base 32 can be fixed in the pushed up condition, thereby facilitating the mounting operation of the cooling unit R.

Moreover, in the relevant arrangement also, the rear pushing-up member 71 is brought into abutment against the lower surface of the mounting base 32 of the cooling unit R to push up the rear portion of the mounting base 32, while by actuating the front pushing-up members 75, 75 to push up the forward end of the mounting base 32, thereby achieving a reduction in cost because of no need for particularly constituting a pushing up structure on the side of the cooling unit R. Further, by mounting the fixing members 72 and the rear and front pushing-up members 71 and 75 onto the angles 12 of the machine room 21, the pushing-up mechanism can be constructed so that various cooling units R may be accommodated and hence the versatility can be enhanced.

In the relevant embodiment of the invention, furthermore, since the stopper 71A as positioning means is provided at the rear pushing-up member 71, mounting position can be defined when the cooling unit R is inserted into the machine room 21, thereby facilitating the mounting operation. In the state that the front pushing-up members 75 stand upright, the cooling unit R comes into the pushed up state, and at this moment, the front pushing-up members 75 are positioned forwardly of the mounting base 32 so that the forward movement of the cooling unit R can be impeded by the front pushing-up members 75. Therefore, the cooling unit R can be easily positioned, thereby achieving simplification of the mounting operation. Moreover, the forward and rearward movement of the cooling unit R in the fixed state can be securely restricted so that the cooling unit R can be stably fixed.

Moreover, as the rear pushing-up member 71 is caused to be pivotally moved in the direction pushing up the cooling unit R and at the same time the front side is also pushed up, the cooling unit R can be stably pushed up toward the bottom wall 2A of the thermal insulating housing 2 without causing any deviation of the position of the cooling unit R back and forth and without any dislodgement from the rear pushing-up member 71.

Furthermore, as the front pushing-up members 75 are each formed with a latching portion 75A adapted to engage the forward end of the pushed up mounting base 32 when the front pushing-up members stand upright, the mounting base 32 and the front pushing-up members 75 are fixed to each other by the engagement of the latching portions with the forward end of the mounting member 32.

While the cooling unit R is inserted into the machine room 21 from its front side in the respective embodiments, it will be apparent that the inserting direction of the cooling unit R may not be limited to such a case.

What is claimed is:

1. A cold storage including a thermal insulating housing, a storage room constructed in the thermal insulating housing, and a machine room constructed under the storage room, comprising:

a cooling unit integrated with a cooler and a blower accommodated in a cooling chamber constructed in a cooling box, and a compressor, a condenser and the like providing them on a mounting base, a cold air discharge port and a cold air suction port which are formed in the bottom wall of the thermal insulating housing, the bottom wall being also a ceiling of the machine room, and communicate the interiors of the storage room and the machine room with each other, positioning means for positioning the cooling unit in the machine room such that the discharge side and the suction side of the cooling chamber correspond to the lower sides of the cold air discharge port and the cold air suction part, and pushing-up means for causing the cooling unit to be pushed up toward the bottom wall of the thermal insulating housing by abutting against the lower surface of the mounting base on its both sides or front and rear sides with respect to a direction inserting the cooling unit into the machine room, wherein the pushing-up means comprises pivotally movable pushing-up members provided respectively over from the front side to the rear side in the machine room at positions corresponding to both the sides of the cooling unit, and operating arms provided on the front side of the pushing-up members for pivotally moving the pushing-up members, and wherein the pushing-up members are pivotally moved in a direction pushing up the mounting base by causing the operating arms from their upright standing state to fall down toward the mounting base.

2. The cold storage of claim 1, wherein the operating arms in fallen down state are able to be fixed to the mounting base.

3. The cold storage of claim 1, wherein the operating arms are each provided at its forward end with a handle portion extending onto front side.

4. The cold storage of claim 1, further comprising link means for interlocking the pushing-up members corresponding to both the sides of the cooling unit.

5. The cold storage of claim 2, wherein the operating arms are each provided at its forward end with a handle portion extending onto front side.

6. The cold storage of claim 2, further comprising link means for interlocking the pushing-up members corresponding to both the sides of the cooling unit.

7. The cold storage of claim 3, further comprising link means for interlocking the pushing-up members corresponding to both the sides of the cooling unit.

8. The cold storage of claim 5, further comprising link means for interlocking the pushing-up members corresponding to both the sides of the cooling unit.

9. A cold storage including a thermal insulating housing, a storage room constructed in the thermal insulating housing, and a machine room constructed under the storage room, comprising:

a cooling unit integrated with a cooler and a blower accommodated in a cooling chamber constructed in a cooling box, and a compressor, a condenser and the like by providing them on a mounting base, a cold air discharge port and a cold air suction port which are formed in the bottom wall of the thermal insulating housing, the bottom wall being also a ceiling of the machine room, and communicate the interiors of the storage room and the machine room with each other, positioning means for positioning the cooling unit in the machine room such that the discharge side and the suction side of the cooling chamber correspond to the lower sides of the cold air discharge port and the cold air suction port, and pushing-up means for causing the cooling unit to be pushed up toward the bottom wall of the thermal insulating housing by abutting against the lower surface of the mounting base on its both sides or front and rear sides with respect to a direction inserting the cooling unit into the machine room, wherein the pushing-up means comprises pivotally movable pushing-up members provided respectively over from the front side to the rear side in the machine room at positions corresponding to both the sides of the cooling unit, and operating arms provided on the front side of the pushing-up members for pivotally moving the pushing-up members, and wherein the pushing-up members are pivotally moved in a direction pushing up the mounting base by causing the operating arms from their fallen down state to stand upright onto the front side of the cooling unit.

10. The cold storage of claim 9, wherein the operating arms are each provided at its forward end with a handle portion extending onto front side.

11. The cold storage of claim 9, further comprising link means for interlocking the pushing-up members corresponding to both the sides of the cooling unit.

12. The cold storage of claim 10, further comprising link means for interlocking the pushing-up members corresponding to both the sides of the cooling unit.

13. A cold storage including a thermal insulating housing, a storage room constructed in the thermal insulating housing, and a machine room constructed under the storage room, comprising:

a cooling unit integrated with a cooler and a blower accommodated in a cooling chamber constructed in a cooling box, and a compressor, a condenser and the like by providing them on a mounting base, a cold air discharge port and a cold air suction port which are formed in the bottom wall of the thermal insulating housing, the bottom wall being also a ceiling of the machine room, and communicate the interiors of the storage room and the machine room with each other, positioning means for positioning the cooling unit in the machine room such that the discharge side and the suction side of the cooling chamber correspond to the lower sides of the cold air discharge port and the cold air suction port, and pushing-up means for causing the cooling unit to be pushed up toward the bottom wall of the thermal insulating housing by abutting against the lower surface of the mounting base on its both sides or front and rear sides with respect to a direction inserting the cooling unit into the machine room, wherein the pushing-up means comprises a pivotally movable rear pushing-up member provided in the machine room at a position corresponding to the rear side of the cooling unit, and pivotally movable front pushing-up members provided in the machine room at positions corresponding to the front side of the cooling unit, wherein by inserting the cooling unit into the machine room, the rear pushing-up member abuts against the mounting base to be pivotally moved in a direction pushing up the mounting base, and wherein by pivotally moving the front pushing-up members from the front side to the rear side, the mounting base is pushed up.

* * * * *